US011255650B2

(12) United States Patent
Sullivan et al.

(10) Patent No.: US 11,255,650 B2
(45) Date of Patent: Feb. 22, 2022

(54) DETONATION SYSTEM HAVING SEALED EXPLOSIVE INITIATION ASSEMBLY

(71) Applicant: XConnect, LLC, Denver, CO (US)

(72) Inventors: Shelby L. Sullivan, Minot, ND (US); Aaron Holmberg, Omaha, NE (US); Nicholas Noel Kleinschmit, Omaha, NE (US)

(73) Assignee: XConnect, LLC, Denver, CO (US)

( * ) Notice: Subject to any disclaimer, the term of this patent is extended or adjusted under 35 U.S.C. 154(b) by 104 days.

(21) Appl. No.: 16/894,512

(22) Filed: Jun. 5, 2020

(65) Prior Publication Data

US 2020/0300593 A1 Sep. 24, 2020

Related U.S. Application Data

(63) Continuation-in-part of application No. 15/808,290, filed on Nov. 9, 2017, now Pat. No. 11,208,873, and (Continued)

(51) Int. Cl.

| | |
|---|---|
| ***E21B 43/1185*** | (2006.01) |
| ***F42D 1/05*** | (2006.01) |
| *E21B 43/117* | (2006.01) |

(52) U.S. Cl.

CPC ..... *F42D 1/05* (2013.01); *E21B 43/1185* (2013.01); *E21B 43/117* (2013.01)

(58) Field of Classification Search

CPC .. E21B 43/117; E21B 43/118; E21B 43/1185; F42D 1/05

(Continued)

(56) References Cited

U.S. PATENT DOCUMENTS 2,029,490 A 2/1936 Lane
2,062,974 A 12/1936 Lane (Continued)

FOREIGN PATENT DOCUMENTS

WO WO-2006063713 A1 * 6/2006 ..... E21B 43/1185

OTHER PUBLICATIONS

Screen shot of OsoLite® Lite'n Your Workload with Oso's Prewired, Disposable Perforating Gun System; https://www.osoperf.com/perf-hardware/osolite; Date of access of Feb. 1, 2021; 2 pages.

(Continued)

*Primary Examiner* — Reginald S Tillman, Jr.
(74) *Attorney, Agent, or Firm* — Peter L. Brewer; Thrive IP

(57) ABSTRACT

A detonation system for a perforating gun assembly. The detonation system includes a tandem sub having a first end and a second opposing end. Each of the first and second ends connects to a respective perforating gun. The tandem sub has an inner bore, and an electronic switch assembly residing within the inner bore. A contact pin also resides within the inner bore of the tandem sub, with the contact pin having a head that extends into the electronic switch assembly and is configured to transmit instruction signals from the surface. A dart is provided near the first end of the tandem sub, with the dart having a base portion and a tip. The dart resides within an end plate, wherein the base portion has an outer diameter that is greater than an inner conduit of the end plate. The dart is configured to seal against the inner bore of the end plate in response to a pressure wave generated by detonation of charges in an adjacent perforating gun, thereby sealing off the tandem sub.

19 Claims, 20 Drawing Sheets

Related U.S. Application Data a continuation-in-part of application No. 16/836,193, filed on Mar. 31, 2020, now Pat. No. 10,914,145.

(60) Provisional application No. 62/423,648, filed on Nov. 17, 2016, provisional application No. 62/890,242, filed on Aug. 22, 2019, provisional application No. 62/987,743, filed on Mar. 10, 2020, provisional application No. 62/845,692, filed on May 9, 2019.

(58) Field of Classification Search
USPC ..... 89/1.15
See application file for complete search history.

(56) References Cited

U.S. PATENT DOCUMENTS

| | | | | |
|---|---|---|---|---|
| 2,264,450 | A | | 12/1941 | Mounce |
| 2,331,058 | A | | 10/1943 | Stick, Jr. |
| 2,621,732 | A | | 12/1952 | Ahlgren |
| 3,032,107 | A | | 5/1962 | Rumble et al. |
| 3,126,964 | A | | 3/1964 | La Rue |
| 3,528,511 | A | | 9/1970 | Boop et al. |
| 3,648,785 | A | | 3/1972 | Walker |
| 3,695,368 | A | | 10/1972 | Lanmon, II |
| 3,945,322 | A | | 3/1976 | Carlson et al. |
| 4,164,886 | A | | 8/1979 | Hallmark |
| 4,457,383 | A | * | 7/1984 | Boop ..... F42D 1/04 175/4.55 |
| 4,491,185 | A | * | 1/1985 | McClure ..... E21B 43/116 102/204 |
| 4,759,291 | A | | 7/1988 | Barker et al. |
| 5,042,594 | A | | 8/1991 | Gonzalez et al. |
| 7,591,212 | B2 | | 9/2009 | Myers, Jr. et al. |
| 7,902,469 | B2 | | 3/2011 | Hurst |
| 8,074,737 | B2 | | 12/2011 | Hill et al. |
| 8,256,337 | B2 | | 9/2012 | Hill et al. |
| 8,395,878 | B2 | | 3/2013 | Stewart et al. |
| 8,875,787 | B2 | | 11/2014 | Tassaroli |
| 9,080,433 | B2 | | 7/2015 | Lanclos et al. |
| 9,145,764 | B2 | | 9/2015 | Burton et al. |
| 9,581,422 | B2 | | 2/2017 | Preiss et al. |
| 9,845,666 | B2 | | 12/2017 | Hardesty et al. |
| 10,066,921 | B2 | | 9/2018 | Eitschberger |
| 10,184,331 | B2 | | 1/2019 | Mace et al. |
| 10,188,990 | B2 | | 1/2019 | Burmeister et al. |
| 10,273,788 | B2 | | 4/2019 | Bradley et al. |
| 10,352,136 | B2 | | 7/2019 | Goyeneche |
| 10,352,674 | B2 | | 7/2019 | Eitschberger |
| 10,365,078 | B2 | | 7/2019 | Eitschberger |
| 10,458,213 | B1 | | 10/2019 | Eitschberger et al. |
| 10,465,462 | B2 | | 11/2019 | Frazier et al. |
| 10,472,938 | B2 | | 11/2019 | Parks et al. |
| 10,502,036 | B2 | | 12/2019 | Spring |
| 10,507,433 | B2 | | 12/2019 | Eitschberger et al. |
| 10,519,733 | B2 | | 12/2019 | Rosenthal et al. |
| 10,519,754 | B2 | | 12/2019 | Prisbell et al. |
| 10,584,950 | B2 | | 3/2020 | Saltarelli et al. |
| 10,641,068 | B2 | | 5/2020 | Hardesty et al. |
| 10,662,750 | B2 | | 5/2020 | Angman et al. |
| 10,669,821 | B2 | | 6/2020 | Knight et al. |
| 10,677,026 | B2 | | 6/2020 | Sokolove et al. |
| 10,689,955 | B1 | | 6/2020 | Mauldin et al. |
| 10,731,444 | B2 | | 8/2020 | Wells et al. |
| 10,731,445 | B2 | | 8/2020 | Akkerman et al. |
| 10,731,955 | B2 | | 8/2020 | Baum |
| 10,844,697 | B2 | | 11/2020 | Preiss et al. |
| 10,900,334 | B2 | | 1/2021 | Knight et al. |
| 10,900,335 | B2 | | 1/2021 | Knight et al. |
| 2011/0271823 | A1 | | 11/2011 | Vicente |
| 2012/0199352 | A1 | | 8/2012 | Lanclos et al. |
| 2012/0247769 | A1 | | 10/2012 | Schacherer et al. |
| 2013/0126237 | A1 | | 5/2013 | Burton et al. |
| 2014/0338552 | A1 | | 11/2014 | Mace et al. |
| 2015/0000509 | A1 | | 1/2015 | Current et al. |
| 2018/0135389 | A1 | | 5/2018 | Sullivan |

OTHER PUBLICATIONS

Screen shot of SWM International Inc. Thunder Disposable Gun System; https://web.archive.org/web/20200109183633/http:/swmtx.com/pdf/thunder_gun.pdf; Date of access of Feb. 1, 2021; 5 pages.
Screen shot of Yellow Jacket Oil Tools: Perforating Guns; https://www.yjoiltools.com/perforating-guns; Date of access of Feb. 1, 2021; 1 page.
Screen shot of Nexus Perforating: Double Nexus Connect (Thunder Gun System); https://www.yjoiltools.com/perforating-guns; Date of access of Feb. 1, 2021; 1 page.
Screen shot of Vigor USA: Perforating Gun Accessories—Economical and Dependable Perforating Gun Accessories; https://vigorusa.com/perforating-gun-accessories/; Date of access of Feb. 1, 2021; 2 page.
Screen shot of Yellow Jacket Oil Tools: Pre-Wired Perforating Gun; https://www.yjoiltools.com/Perforating-Guns/Pre-Wired-Perforating-Gun; Date of access of Feb. 1, 2021; 1 page.
Screen shot of GR Energy Services—ZipFire™ ReFrac gun system; https://www.grenergyservices.com/zipfire-refrac/; Date of access of Feb. 1, 2021; 2 pages.
Screen shot of GR Energy Services—ZipFire™ high-efficiency perforating system answers current completion demands for higher stage-per-day performance; https://www.grenergyservices.com/zipfire/; date of access of Feb. 1, 2021; 2 pages.
Screen shot of Rock Faithwell—Perforating Gun System; http://www.cnrock.com.cn/h-col-116.html; date of access of Feb. 1, 2021; 2 pages.
Screen shot of APT American—Perforating Guns; https://aptamerican.com/perforating-guns; date of access of Feb. 1, 2021; 1 page.
Screen shot of NexTier—Innovative Solutions: GameChanger™ Perforating System; https://nextierofs.com/solutions/innovative-solutions/gamechanger/; date of access of Feb. 1, 2021; 2 pages.
GEODynamics' EPIC™ Switches Brochure; GEODynamics; Copyright 2020; v.03; 1 page.
Josh Howk and Adam Dyess; "Mitigating the Problems in Select-Fire Perforating Operations" IPS 16-22; 2016 International Perforating Symposium Galveston; May 10, 2016; 15 pages.
Hunting Titan Brochure; Hunting Energy Services; Copyright 2020; v.9.1; 27 pages.

* cited by examiner

DETONATION SYSTEM HAVING SEALED EXPLOSIVE INITIATION ASSEMBLY

STATEMENT OF RELATED APPLICATIONS

The present application is filed as a Continuation-In-Part of U.S. Ser. No. 15/808,290 filed Nov. 9, 2017. That application is entitled "Switch Sub With Two Way Sealing Features and Method."

The '290 application claimed the benefit of U.S. Ser. No. 62/423,648 filed Nov. 17, 2016. That application is entitled "Switch Sub."

The present application further claims the benefit of U.S. Ser. No. 62/890,242 filed Aug. 22, 2019. That application is entitled "Explosive Initiation Assembly For a Tandem Sub."

This application further claims the benefit of U.S. Ser. No. 62/987,743 filed Mar. 10, 2020. That application is entitled "Detonation System Having Sealed Explosive Initiation Assembly."

The present application is also filed as a Continuation-In-Part of U.S. Ser. No. 16/838,193 filed Mar. 31, 2020. That application is entitled "A Bulkhead Assembly for a Tandem Sub, and an Improved Tandem Sub."

Each of these applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

TECHNICAL FIELD OF THE INVENTION

The present disclosure relates to the field of hydrocarbon recovery operations. More specifically, the invention relates to a tandem sub used to mechanically and electrically connect detonation tools in a perforating gun assembly. Further still, the invention relates to an assembly residing within a tandem sub for initiating an explosive charge for a perforating gun, and further, to a detonation assembly that protects the electronics located inside of the tandem sub from wellbore fluid and debris produced by the detonation of charges from an associated perforating gun.

DISCUSSION OF THE BACKGROUND

In the drilling of an oil and gas well, a near-vertical wellbore is formed through the earth using a drill bit urged downwardly at a lower end of a drill string. After drilling to a predetermined depth, the drill string and bit are removed and the wellbore is lined with a string of casing. An annular area is thus formed between the string of casing and the formation penetrated by the wellbore.

A cementing operation is conducted in order to fill or "squeeze" the annular volume with cement along part or all of the length of the wellbore. The combination of cement and casing strengthens the wellbore and facilitates the zonal isolation, and subsequent completion, of hydrocarbon-producing pay zones behind the casing.

In connection with the completion of the wellbore, several strings of casing having progressively smaller outer diameters will be cemented into the wellbore. These will include a string of surface casing, one or more strings of intermediate casing, and finally a production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include the production casing.

FIG. 1 is a side, cross-sectional view of a wellbore 100, in one embodiment. The wellbore 100 has been completed horizontally, that is, it has a horizontal leg 156. The wellbore 100 defines a bore 10 that has been drilled from an earth surface 105 into a subsurface 110. The wellbore 100 is formed using any known drilling mechanism, but preferably using a land-based rig or an offshore drilling rig operating on a platform.

The wellbore 100 is completed with a first string of casing 120, sometimes referred to as surface casing. The wellbore 100 is further completed with a second string of casing 130, typically referred to as an intermediate casing. In deeper wells, that is, wells completed below 7,500 feet, at least two intermediate strings of casing will be used. In FIG. 1, a second intermediate string of casing is shown at 140.

The wellbore 100 is finally completed with a string of production casing 150. In the view of FIG. 1, the production casing 150 extends from the surface 105 down to a subsurface formation, or "pay zone" 115. The wellbore 100 is completed horizontally, meaning that a horizontal "leg" 156 is provided. The production casing 150 extends across the horizontal leg 156.

It is observed that the annular region around the surface casing 120 is filled with cement 125. The cement (or cement matrix) 125 serves to isolate the wellbore 100 from fresh water zones and potentially porous formations around the casing string 120.

The annular regions around the intermediate casing strings 130, 140 are also filled with cement 135, 145. Similarly, the annular region around the production casing 150 is filled with cement 155. However, the cement 135, 145, 155 is optionally only placed behind the respective casing strings 130, 140, 150 up to the lowest joint of the immediately surrounding casing string. Thus, a non-cemented annular area 132 is typically preserved above the cement matrix 135, a non-cemented annular area 142 may optionally be preserved above the cement matrix 135, and a non-cemented annular area 152 is frequently preserved above the cement matrix 155.

The horizontal leg 156 of the wellbore 100 includes a heel 153 and a toe 154. In this instance, the toe 154 defines the end (or "TD") of the wellbore 100. In order to enhance the recovery of hydrocarbons, particularly in low-permeability formations 115, the casing 150 along the horizontal section 156 undergoes a process of perforating and fracturing (or in some cases perforating and acidizing). Due to the very long lengths of new horizontal wells, the perforating and formation treatment process is typically carried out in stages.

In one method, a perforating gun assembly 200 is pumped down towards the end of the horizontal leg 156 at the end of a wireline 240. The perforating gun assembly 200 will include a series of perforating guns (shown at 210 in FIG. 2), with each gun having sets of charges ready for detonation. The charges associated with one of the perforating guns are detonated and perforations are "shot" into the casing 150. Those of ordinary skill in the art will understand that a perforating gun has explosive charges, typically shaped, hollow or projectile charges, which are ignited to create holes in the casing (and, if present, the surrounding cement) 150 and to pass at least a few inches and possibly several feet into the formation 115. The perforations (not shown) create fluid communication with the surrounding formation 115 so that hydrocarbon fluids can flow into the casing 150.

After perforating, the operator will fracture (or otherwise stimulate) the formation 115 through the perforations (not shown). This is done by pumping treatment fluids into the formation 115 at a pressure above a formation parting pressure. After the fracturing operation is complete, the wireline 240 will be raised and the perforating gun assembly 200 will be positioned at a new location (or "depth") along the horizontal wellbore 156. A plug (such as plug 112) is set below the perforating gun assembly 200 using a setting tool 116, and new shots are fired in order to create a new set of perforations. Thereafter, treatment fluid is again pumping into the wellbore 100 and into the formation 115 at a pressure above the formation parting pressure. In this way, a second set (or "cluster") of fractures is formed away from the wellbore 156.

The process of setting a plug, perforating the casing, and fracturing the formation is repeated in multiple stages until the wellbore has been completed, that is, it is ready for production. A string of production tubing (not shown) is then placed in the wellbore to provide a conduit for production fluids to flow up to the surface 105.

In order to provide perforations for the multiple stages without having to pull the perforating gun 200 after every detonation, the perforating gun assembly 200 employs multiple guns in series. FIG. 2 is a side view of an illustrative perforating gun assembly 200, or at least a portion of an assembly. The perforating gun assembly 200 comprises a string of individual perforating guns 210.

Each perforating gun 210 represents various components. These typically include a "gun barrel" 212 which serves as an outer tubular housing. An uppermost gun barrel 212 is supported by an electric wire (or "e-line") 240 that extends from the surface 105 and delivers electrical energy down to the tool string 200. Each perforating gun 210 also includes an explosive initiator, or "detonator" (shown at 594 in FIG. 15C). The detonator is typically a small aluminum housing having a resistor inside. The detonator receives electrical energy from the surface and through the e-line, which heats the resistor.

The detonator is surrounded by a sensitive explosive material. When current is run through the detonator, a small explosion is set off by the electrically heated resistor. This small explosion sets off an adjacent detonating cord (shown at 595 in FIG. 15B).

The detonating cord contains an explosive compound that is detonated by the detonator. The detonator, in turn, initiates one or more shots, typically referred to as "shaped charges." The shaped charges are held in an inner tube, referred to as a carrier tube, for security and discharge through openings 215 in the selected gun barrel 212. The detonating cord propagates an explosion down its length to each of the shaped charges along the carrier tube (shown at 500 in FIG. 6).

The perforating gun assembly 200 may include short centralizer subs 220. In addition, tandem subs 225 are used to connect the gun barrel housings 212 end-to-end. Each tandem sub 225 comprises a metal threaded connector placed between the gun barrels 210. Typically, the gun barrels 210 will have female-by-female threaded ends while the tandem sub 225 has opposing male threaded ends.

The perforating gun assembly 200 with its long string of gun barrels (the housings 212 of the perforating guns 210) is carefully assembled at the surface 105, and then lowered into the wellbore 10 at the end of the e-line 240. The e-line 240 extends upward to a control interface (not shown) located at the surface 105. An insulated connection member 230 connects the e-line 240 to the uppermost perforating gun 210. Once the assembly 200 is in place within a wellbore, an operator of the control interface sends electrical signals to the perforating gun assembly 200 for detonating the shaped charges 215 and for creating perforations into the casing 150.

After the casing 150 has been perforated and at least one plug 112 has been set, the setting tool 120 and the perforating gun assembly 200 are taken out of the wellbore 100 and a ball (not shown) is dropped into the wellbore 100 to close the plug 112. When the plug 112 is closed, a fluid (e.g., water, water and sand, fracturing fluid, etc.) is pumped by a pumping system down the wellbore (typically through coiled tubing) for fracturing purposes.

As noted, the above operations may be repeated multiple times for perforating and/or fracturing the casing 150 at multiple locations, corresponding to different stages of the well. Multiple plugs may be used for isolating the respective stages from each other during the perforating phase and/or fracturing phase. When all stages are completed, the plugs are drilled out and the wellbore is cleaned using a circulating tool.

It can be appreciated that a reliable electrical connection must be made between the gun barrels 210 in the tool string 200 through each tandem sub 225. Currently, electrical connections are made using a side entrance port on the tandem sub 225 to manually connect wires. When the charges are fired, the electronics in each carrier tube are lost and the tandem subs are frequently sacrificed.

A need exists for a detonation system wherein the electronic switch is housed within the tandem sub such that the wiring connections may be pre-assembled before the perforating guns are delivered to the field. A need further exists for a detonation system utilizing a tandem sub having a carrier end plate and a dart, wherein the dart and end plate mechanically and fluidically seal off the tandem sub from wellbore fluids and debris following detonation of explosive charges in an associated perforating gun.

SUMMARY OF THE INVENTION

A detonation system for a perforating gun assembly is provided. The detonation system utilizes an electronic switch assembly that transmits signals to a detonator in a perforating gun. The detonator, in turn, ignites an explosive material, creating an explosion that is passed through a detonating cord. The detonating cord then ignites the shaped charges along the perforating gun.

The detonation system first includes a tandem sub. The tandem sub defines a short tubular body having a first end and a second opposing end. A circular shoulder may be provided intermediate the first and second ends. The first and second ends comprise male threads that are configured to connect to the gun barrel of adjacent perforating guns. The gun barrels are threaded onto the opposing ends of the tandem sub until they reach the intermediate shoulder.

As noted, the detonation system also includes the switch assembly. The switch assembly includes an addressable switch. Beneficially, the switch assembly with its addressable switch resides entirely within the tandem sub located adjacent to the perforating gun being fired.

The detonation system also comprises an inner bore within the tandem sub. The inner bore extends from the first end of the tandem sub to the second opposing end. The electronic switch assembly resides within the inner bore of the tandem sub proximate the first end.

The detonation system additionally comprises a contact pin. The contact pin also resides within the inner bore of the tandem sub. The contact pin has a head that extends from a bulkhead and into the electronic switch assembly. The contact pin is fabricated substantially from a conductive material, and is configured to receive instruction signals from the surface.

The detonation system also has an end plate. The end plate resides between the carrier tube of a connected perforating gun, and the tandem sub. The end plate includes an inner conduit having an angled surface. Of interest, the inner bore of the tandem sub receives one or more wires from the electronic switch assembly, passing them through the inner conduit en route to the carrier tube.

The detonation system further comprises a detonator. The detonator resides within the carrier tube and is in electrical communication with the electronic switch assembly by means of the one or more wires. The detonator receives a detonation signal from the electronic switch assembly by means of the wires. Heat is generated within the detonator as described above, igniting an explosive material within an adjacent detonating cord. The detonator and detonating cord reside in the perforating gun. The detonating cord connects to explosives associated with shaped charges along the carrier tube.

The detonation system additionally includes a dart. The dart comprises a base portion and a tip. The base portion defines an outer diameter that is greater than the inner conduit of the end plate, but with the tip extending at least partially into the inner conduit. Of interest, the dart is configured to seal against the inner conduit of the end plate in response to a pressure wave generated by detonation of the one or more charges in the perforating gun. In this way, the electronic switch assembly and tandem sub are protected from the pressure wave and may be used again as part of a subsequent perforating operation, with minimal cleaning.

The perforating gun comprises a gun barrel threadedly connected to the tandem sub at the first end of the tandem sub, and a carrier tube residing within the gun barrel. The carrier tube carries the shaped charges used in the formation of perforations.

In one embodiment, the detonation system also includes a dart retainer. The dart retainer resides within the carrier tube adjacent the end plate. The dart retainer defines a tubular body having an inner diameter. The inner diameter is dimensioned to slideably hold at least a portion of the base of the dart before the charges are detonated.

In another embodiment, the detonation system comprises a tubular stem. The tubular stem has an inner diameter and an outer diameter. A first end of the stem is threadedly connected to the end plate, aligning the inner diameter of the stem with the conduit of the end plate. A head of the contact pin extends into the inner diameter of the stem, while the addressable switch resides along the outer diameter of the stem. Note that the stem itself resides within the bore of the tandem sub proximate the first end.

In the detonation system, the gun barrel may be downstream of the tandem sub. Alternatively and more preferably, the gun barrel is upstream of the tandem sub. In either instance, the tandem sub preferably and uniquely has no intermediate port.

In operation, the detonation system is part of the perforating gun assembly. The perforating gun assembly is run into a wellbore at the end of an electric line. More specifically, the perforating gun assembly is pumped into the horizontal portion of the wellbore. The contact pin is in electrical communication with the e-line, with the e-line extending from the perforating gun assembly up to the surface. When a signal is sent through the e-line, it is carried through the perforating gun assembly by means of the signal line residing within the string of perforating guns and tandem subs.

The addressable switch filters instruction signals from the operator at the surface. When the addressable switch receives a signal associated with its perforating gun, the addressable switch will send a detonation signal through one or more wires and back up to the detonator. The detonator, in turn, ignites the explosive material that passes through the detonating cord and on to the charges along the carrier tube.

In addition to the detonation system, a tandem sub for a perforating gun assembly is also provided herein. The tandem sub comprises a first end and an opposing second end. The first end represents a male connector and is threadedly connected to a first perforating gun. Similarly, the second end represents a male connector and is threadedly connected to a second perforating gun.

The first end abuts a first end plate while the second end abuts a second end plate. An inner bore extends between the first end of the tandem sub and the second end.

An electronic switch assembly resides within the inner bore at the first end of the tandem sub. The switch assembly comprises an addressable switch configured to receive instruction signals from an operator at the surface. In addition, a receptacle is positioned within the inner bore of the tandem sub proximate the second end. The receptacle is dimensioned to closely receive a bulkhead, wherein the bulkhead comprises:

- a tubular body having a first end, a second end and a bore extending there between;
- an electrical contact pin having a shaft extending through the bore of the bulkhead body and having a first end and a second end, wherein the shaft frictionally resides within the bore, and wherein the electrical contact pin transmits current from the first end to the second end; and
- a contact head located at the second end of the electrical contact pin outside of the bulkhead body and extending into the electronic switch assembly.

The contact pin is fabricated substantially from a conductive material. The contact head transmits instruction signals from the electric line to a downstream perforating gun, and more particularly to the addressable switches located within downstream perforating guns. When an instruction signal is recognized by an addressable switch, the addressable switch will send a detonation signal to an associated detonator.

In one aspect, the first end plate comprises a bore that represents a first internal chamber formed at a first end of the end plate, and a second internal chamber formed at a second end of the end plate. A conduit connects the first internal chamber to the second internal chamber. One or more wires pass from the addressable switch, back up through the bore, and to a detonator residing within the first perforating gun. The detonator is configured to receive a detonation signal from the addressable switch.

As noted above, the detonator defines a small aluminum housing having a resistor inside. The resister is surrounded by a sensitive explosive material. When current is run through the detonator, a small explosion is set off by the electrically heated resistor. This small explosion ignites an explosive material placed within the detonating cord. As the explosive material is ignited, the detonating cord delivers the explosion to shaped charges along the first perforating gun.

In a preferred embodiment, a dart resides in the first internal chamber of the first end plate and opposite the switch assembly. The dart further comprises a base located in the first internal chamber, with the base having a diameter that is larger than the conduit. This prevents the dart from traversing through the conduit following detonation of the shaped charges in the first perforating gun. The dart also has a tip that extends at least partially into the conduit between the first and second internal chambers.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DEFINITIONS

Figure 1:
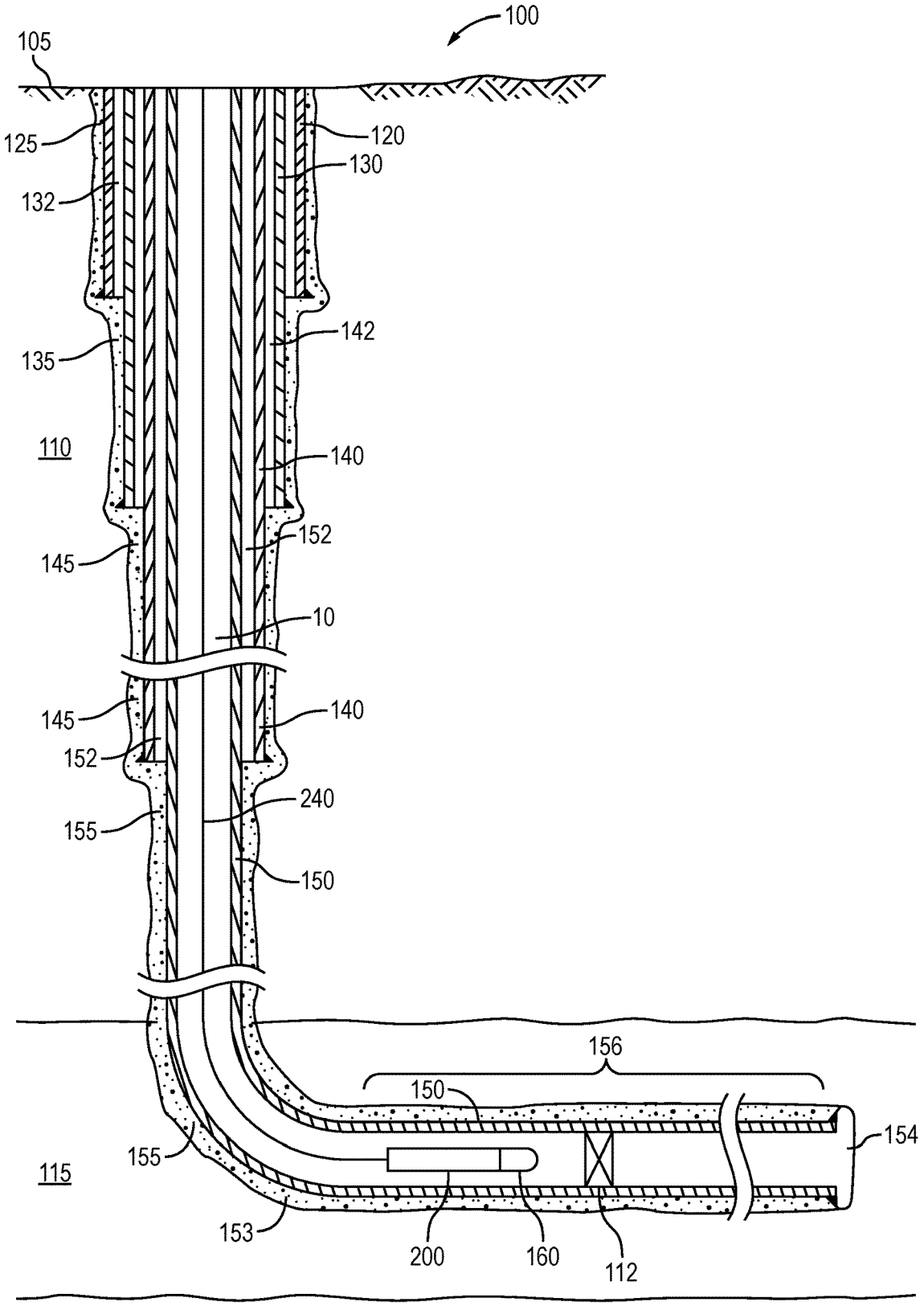
FIG. 1 (Prior Art)
FIG. 1 is a cross-sectional side view of a wellbore. The wellbore is being completed with a horizontal leg. A perforating gun assembly is shown having been pumped into the horizontal leg at the end of an e-line.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Reference herein to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

DETAILED DESCRIPTION OF CERTAIN EMBODIMENTS

The following description of the embodiments refers to the accompanying drawings. The same reference numbers in different drawings identify the same or similar elements. The following detailed description does not limit the invention; instead, the scope of the invention is defined by the appended claims. The following embodiments are discussed, for simplicity, with regard to attaching two perforating guns to each other through a tandem sub. In the following, the terms "upstream" and "downstream" are being used to indicate that one gun barrel may be situated above and one below, respectively. However, one skilled in the art would understand that the invention is not limited only to the upstream gun or only to the downstream gun, but in fact can be applied to either gun. In other words, the terms "upstream" and "downstream" are not necessarily used in a restrictive manner, but only to indicate, in a specific embodiment, the relative positions of perforating guns or other components.

Figure 3:
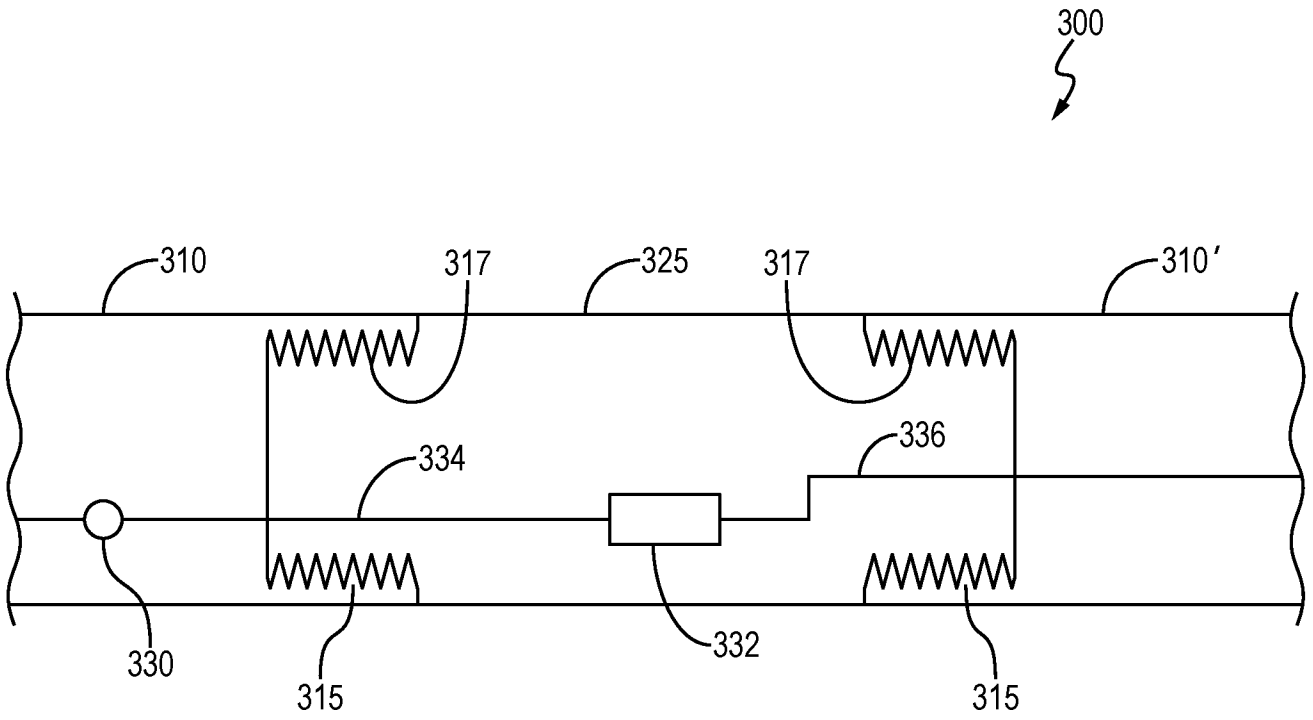
FIG. 3 is a schematic side view of a tandem sub. A gun barrel is connected to each of opposing ends of the tandem sub.

FIG. 3 is a cross-sectional view of a portion of a perforating gun assembly 300. The perforating gun assembly 300 is shown schematically, and first comprises a tandem sub 325. The perforating gun assembly 300 also includes a first perforating gun 310 at a first end of the tandem sub 325, and a second perforating gun 310' at a second opposite end of the tandem sub 325.

Each perforating gun 310 comprises a tubular housing having first and second opposing ends. Each end comprises female threads 315. In the view of FIG. 3, the tandem sub 325 has male threaded ends 317 that connect to respective perforating guns 310, 310' via the female threads 315. Thus, the tandem sub 325 is used to connect gun barrels of perforating guns 310 in series.

An electronic switch 332 is located inside the tandem sub 325. The switch 332 is electrically connected through signal line 334 to the e-wireline (shown at 240 in FIG. 1) for receiving instruction signals from the surface. In the view of FIG. 3, the signal line 334 extends from the first perforating gun 310. A separate signal line 336 connects the switch 332 down to the second perforating gun 310'. The second signal line 336 sends instructions signals from the surface on to perforating guns that are downstream of switch 332. It is understood that signal lines 334 and 336 may be considered as a single signal line that extends along the entire length of a perforating gun assembly 200 when the tool is run into a wellbore 100.

FIG. 3 shows a simplified configuration in which signal line 334 is connected to a shaped charge 330. One skilled in the art would understand that a detonator is connected to signal line 334, and the detonator ignites explosive material within a detonating cord, which in turn detonates a plurality of shaped charges like charge 330. It is further understood that each perforating gun in the perforating gun assembly 200 will likely have its own detonator.

Where a series of gun barrels is used in a perforating gun assembly 200, the signal from the wireline 240 will be transmitted through the series of gun barrels 210, 210', etc. and a corresponding contact pins (shown at 570 in FIGS. 18 and 19) to the perforating guns 210 intended to be activated. Typically, guns are activated in series, from the downstream end of the tool string up. Instructions signals are sent through the perforating gun assembly by means of the signal line 334/336.

The switches "listen" for a detonation signal sent through the signal line 334/336. When a detonation signal is received, the switch 332 sends a corresponding detonation signal through the line 334 to the detonator (not shown) for activating a shaped charge 330 (also shown at 520 in FIG. 6) of the first (or upstream) perforating gun 310.

In FIG. 3, the first perforating gun 310 is located upstream from the second perforating gun 310'. When a detonation charge in perforating gun 310' is detonated, debris from the detonation likely will not enter the tandem sub 325. However, when the detonation charges in upstream perforating gun 310 are later detonated, debris from the detonation along with wellbore fluid and/or a pressure wave will enter the tandem sub 325 and damage the switch 332. Although the tandem sub 325 may be reusable after the detonation of the perforating gun 310, the electronics 332 inside the tandem sub 325 are not. This means that when the assembly 300 is brought to the surface 105 and prepared for another deployment, the electronics 332 inside the tandem sub 325 need to be replaced. Further, the inside chamber of the sub 325 needs to be cleaned. These steps add to the cost of the perforating operation.

Thus, it is desirable to have a detonation system wherein the inside electronics are protected from the debris and wellbore fluids generated by the pressure wave caused by the detonation of the downstream charges so that, after a perforating process is completed, both the tandem sub 325 and its electronics 332 can be reused. It is also desirable to provide a novel tandem sub having an inner bore that houses the electronic switch assembly, coupled with a novel end plate that receives a sealing dart. This may be referred to herein as a sealed explosive initiation assembly.

Figure 4:
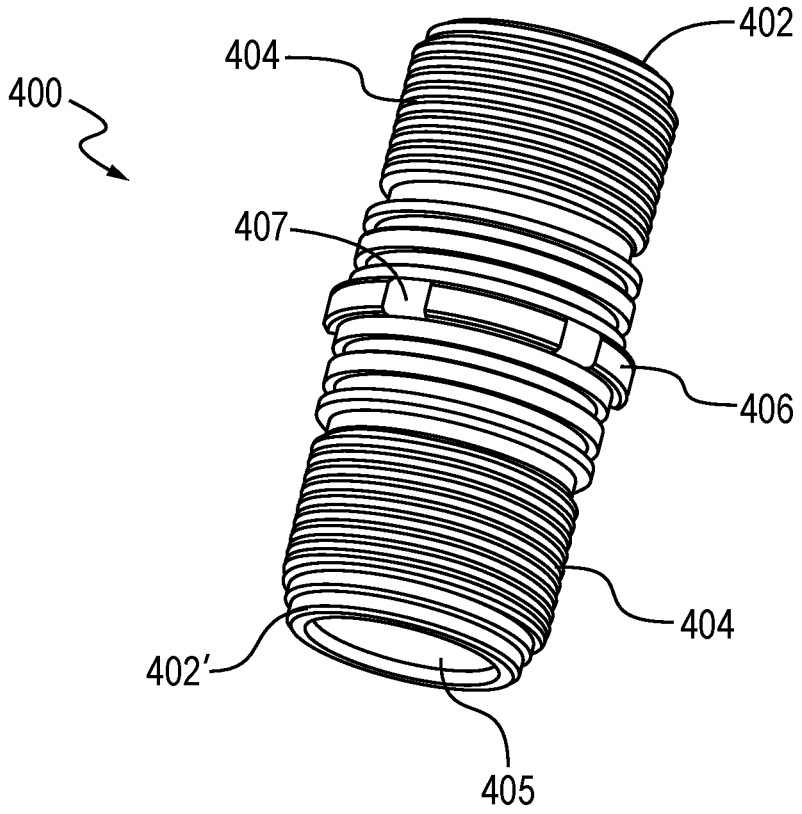
FIG. 4 is a perspective view of a tandem sub of the present invention, in one embodiment.

FIG. 4 is a perspective view of an illustrative tandem sub 400. The tandem sub 400 defines a short tubular body having a first end 402 and a second opposing end 402'. The tandem sub 400 may be, for example, 0.25 inches to 5.5 inches in length, with the two ends 402, 402' being mirror images of one another. Preferably, the tubular body forming the tandem sub 400 is portless, as shown in FIG. 4.

The tandem sub 400 includes externally machined threads 404. The threads 404 are male threads dimensioned to mate with female threaded ends 315 of a gun barrel housing, such as perforating guns 310, 310' of FIG. 3. The tandem sub 400 is preferably dimensioned in accordance with standard 3⅛" gun components. This allows the tandem sub 400 to be threadedly connected in series with perforating guns from any American vendor, e.g., Geo-Dynamics® and Titan®.

Interestingly, if the operator begins having multiple misruns due to a problem with the detonator, then the portless tandem sub 400 (and internal electronic assembly 550 and dart 700, described below) allow the operator to switch to a new batch number, or even to switch vendors completely. The detonation system of the present invention also allows the operator to select the gun lengths, shot densities and phasing that are available on the market. Thus, a plug-n-play system that may be used with perf guns from different vendors is provided.

Intermediate the length of the tandem sub 400 and between the threads 404 is a shoulder 406. The shoulder 406 serves as a stop member as the tandem sub 400 is screwed into the end 317 of a gun barrel 310. Optionally, grooves 407 are formed equi-radially around the shoulder 406. The grooves 407 cooperate with a tool (not shown) used for applying a rotational force to the tandem sub 400 without harming the rugosity of the shoulder 406.

The tandem sub 400 includes a central bore 405. As will be described in greater detail below, the bore 405 is dimensioned to hold novel electronics associated with a perforating gun assembly 210. Such electronics represent an electronic switch assembly as shown at 550 in FIGS. 12A and 12B, and a stem as shown at 540 in FIGS. 8 and 12A.

Figure 5:
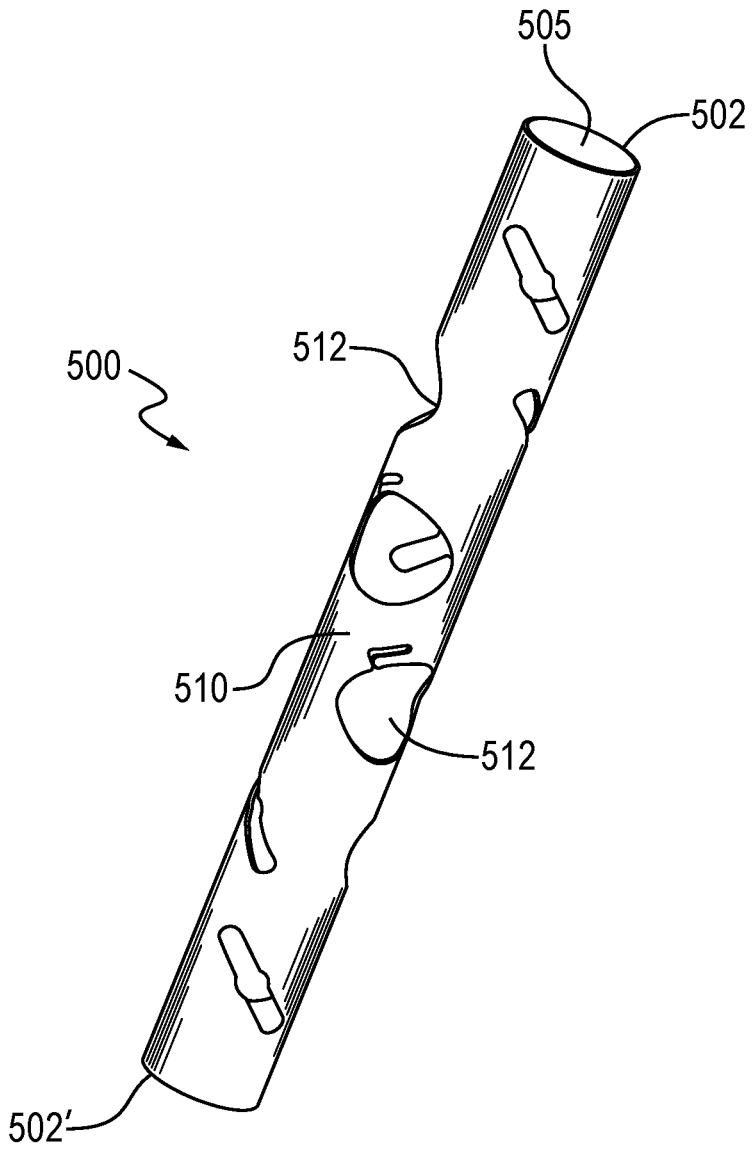
FIG. 5 (Prior Art)
FIG. 5 is a perspective view of an illustrative carrier tube for a perforating gun.

FIG. 5 is a perspective view of an illustrative carrier tube 500 for a perforating gun 210. The carrier tube 500 defines an elongated tubular body 510 having a first end 502 and a second opposing end 502'. The carrier tube 500 has an inner bore 505 dimensioned to receive charges (shown at 520 in FIG. 6). Openings 512 are provided for receiving the charges 520 and enabling the charges 520 to penetrate a surrounding casing string 150 upon detonation.

Figure 2:
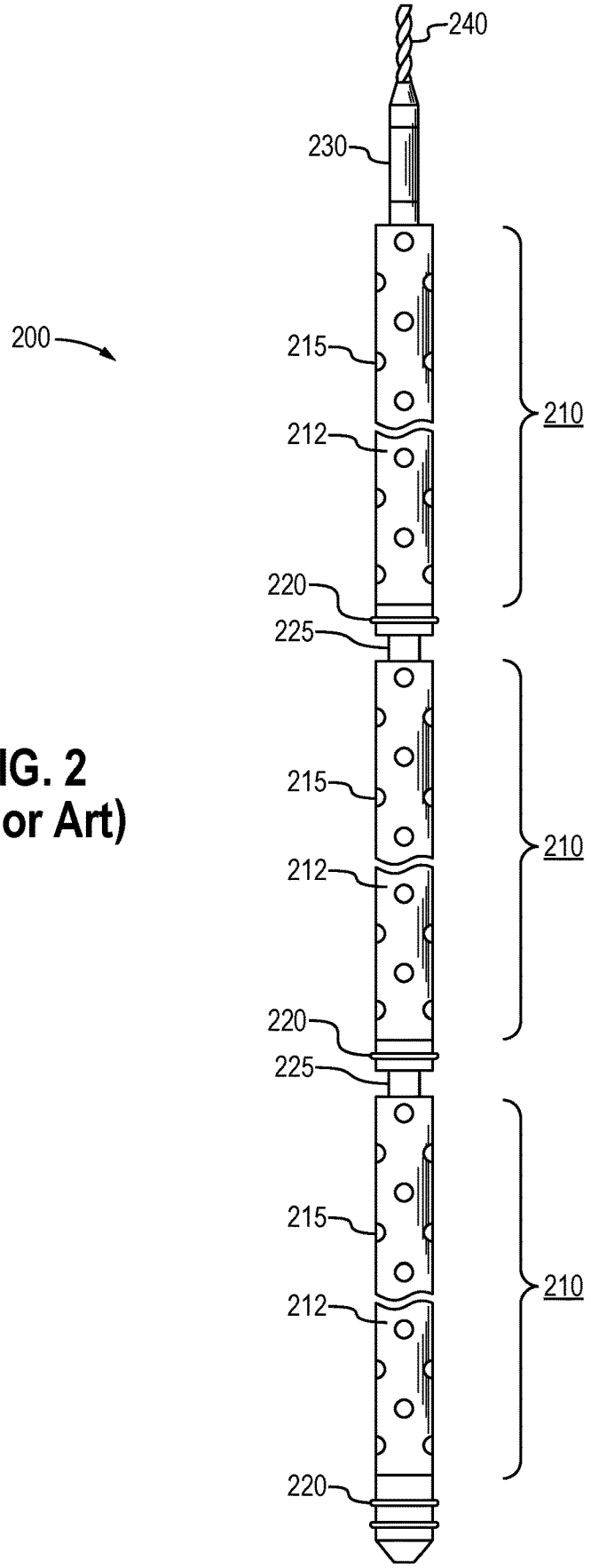
FIG. 2 (Prior Art)
FIG. 2 is a side view of a perforating gun assembly. The perforating gun assembly represents a series of perforating guns having been threadedly connected end-to-end. Tandem subs are shown between gun barrels of the perforating guns, providing the threaded connections.
Figure 6:
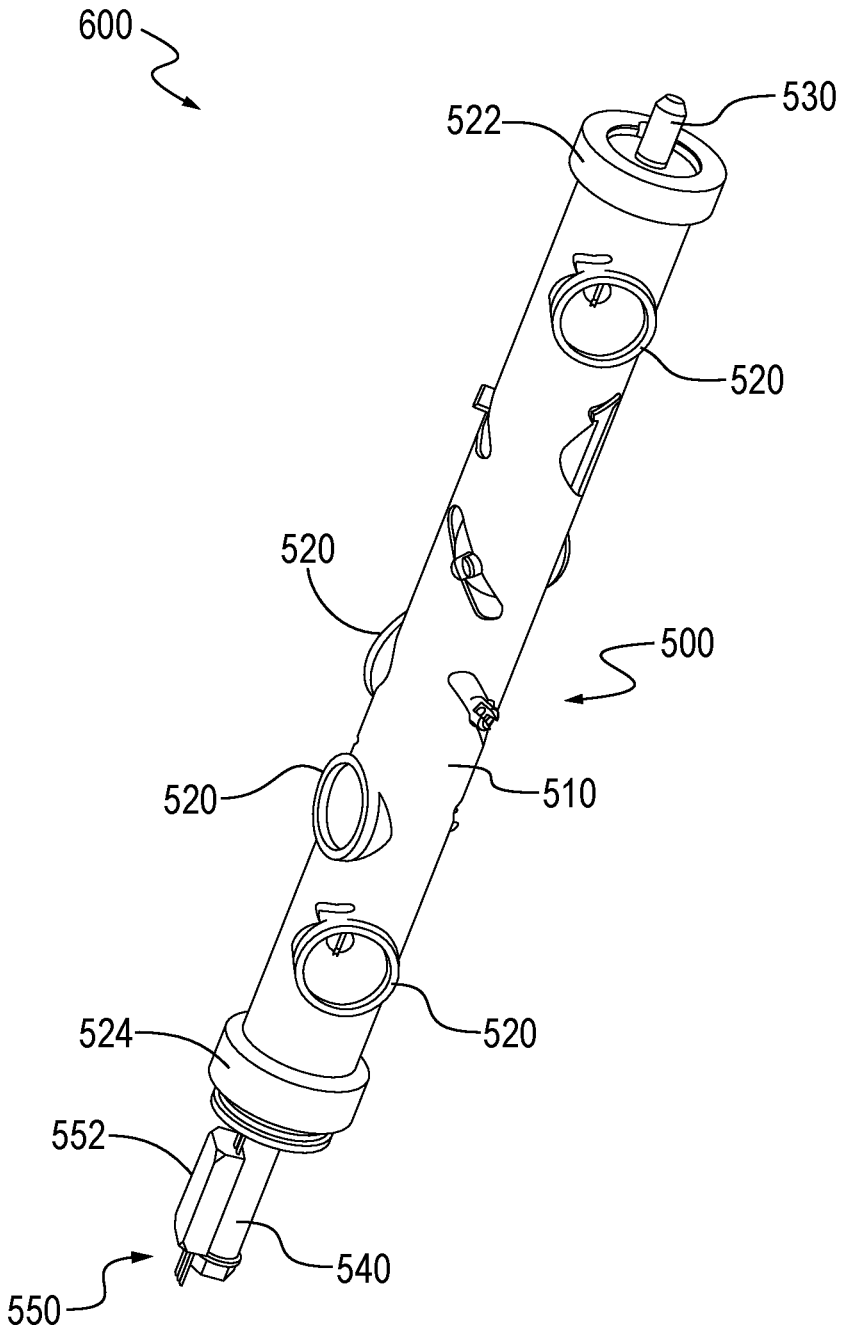
FIG. 6 is a perspective view of a portion of a perforating gun assembly of the present invention, in one aspect. A carrier tube having received shaped charges is shown with end plates having closed the top and bottom ends of the carrier tube. An electronic switch assembly of the present invention is shown at a bottom end of the carrier tube.

FIG. 6 is a perspective view of the carrier tube 500 having received shaped charges 520. Specifically, the charges 520 are placed within openings 512 along the carrier tube 500. Each shaped charge 520 is designed to detonate in response to an explosive passed through the detonating cord. End plates 522, 524 have mechanically enclosed top and bottom ends of the carrier tube 500, respectively. The end plates 522, 524 help center the carrier tube 500 and its charges 520 within an outer gun barrel (not shown in FIG. 6 but shown at 212 in FIG. 2).

An electronic detonator and a detonating cord (shown at 594 and 595 in FIG. 15B, respectively) reside inside the carrier tube 500. The carrier tube 500 and charges 520 together with the gun barrel 212 form a perforating gun 210, while the perforating gun 210 along with the portless tandem sub 400, the end plates 522, 524, the detonator 594, the detonating cord 595 and the electronics 550 form a perforating gun assembly 600. The carrier tube 500 and the gun barrel 212 are intended together to be illustrative of any standard perforating gun, so long as the gun provides a detonator and detonating cord internal to the carrier tube 500.

FIG. 6 also includes novel features of aspects of the invention herein. These include an addressable switch 552, a stem 540 and other features which are described below.

Figure 7A:
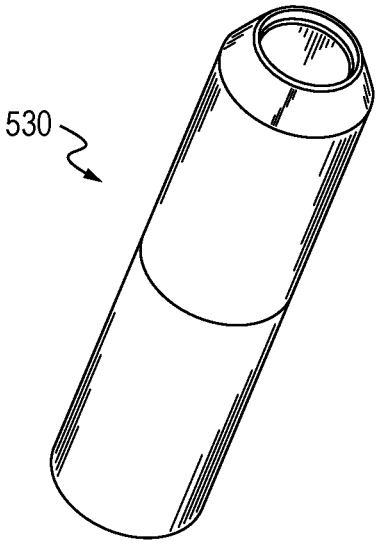
FIG. 7A is an insulator as may be used at a top end plate of the perforating gun assembly of FIG. 6.

FIG. 7A is a perspective view of an insulator 530. The insulator 530 defines a generally tubular body. The insulator 530 extends from the top end plate 522 of the perforating gun assembly 600 of FIG. 6. The insulator 530 receives electrical wires from an upstream tandem sub 400, including a signal wire that transmits instruction signals from an operator at the surface.

Figure 8A:
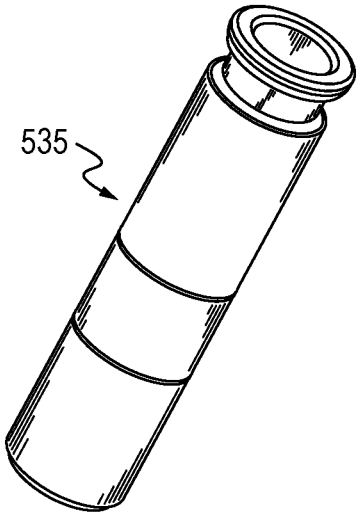
FIG. 8A is an insulator as may be used at a bottom end plate of the perforating gun assembly of FIG. 6. The insulator resides within the stem of FIGS. 6 and 8.
Figure 8:
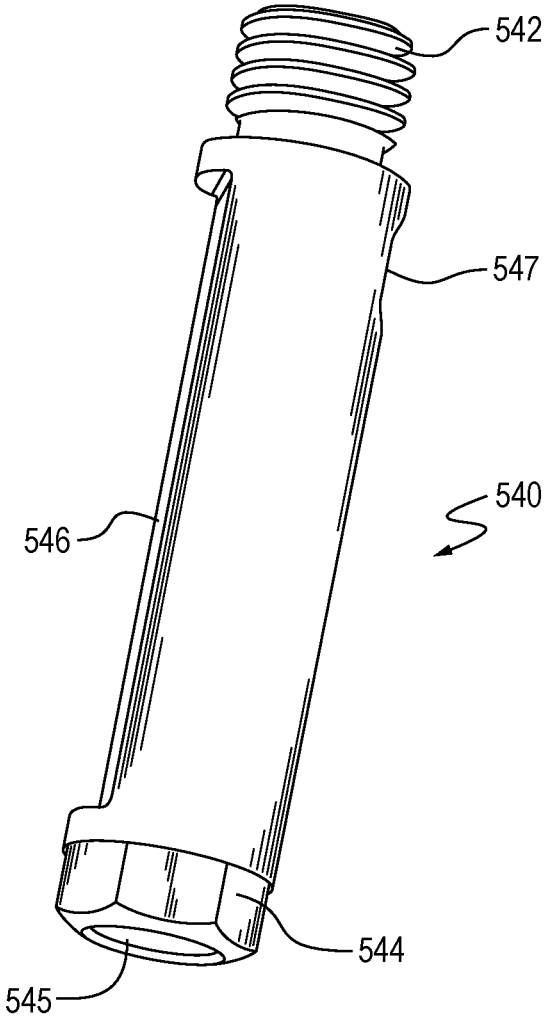
FIG. 8 is a perspective view of a stem. The stem is a tubular body that is dimensioned to support an addressable switch along an outer diameter, and to receive an electric contact in an inner diameter. The stem also resides at the lower end of the perforating gun assembly of FIG. 6, and within a tandem sub.

FIG. 8 is a perspective view of a stem 540. The stem 540 also comprises a tubular body. One end 542 of the stem 540 comprises male threads while an opposing end 544 comprises hex sides and female threads. A flat surface 546 is provided along a side of the stem 540. The flat surface 546 is configured to receive the addressable switch 552, shown in FIG. 6 and also in FIGS. 12A and 12B described below.

The stem 540 is preferably fabricated from steel or other durable metal. The stem 540 extends from the bottom end plate 524 of the perforating gun assembly 600. As seen in FIG. 12B, the stem 540 has an inner diameter that receives an insulator 535. The insulator 535, in turn, receives a proximal contact pin 560, a spring 565 and a contact head 572.

FIG. 8A is a perspective view of the insulator 535. The insulator 535 resides at the bottom end plate 524 of the perforating gun assembly 600. As noted, the insulator 535 resides within the stem of FIGS. 8 and 12B and insulates the proximal contact pin 560, the spring 565 and the contact head 572 mentioned above.

Figure 9:
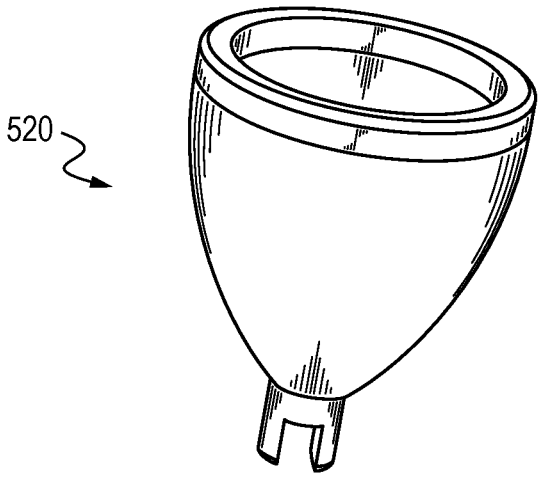
FIG. 9 (Prior Art)
FIG. 9 is a perspective view of a known shaped charge as may be used in the perforating gun assembly of FIG. 6.

FIG. 9 is a perspective view of a shaped charge 520 as used in the perforating gun assembly 600 of FIG. 6. It is understood that the shaped charge 520 and the carrier tube 500 are illustrative, and that the current inventions are not limited to any particular type, model or configuration of charges, carrier tubes or gun barrels unless expressly so provided in the claims.

Figure 10:
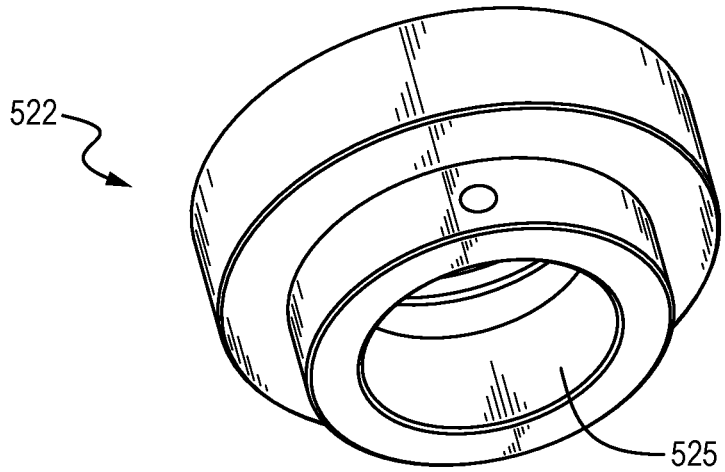
FIG. 10 is a perspective view of the top end plate of the perforating gun assembly of FIG. 6.

FIG. 10 is a perspective view of the top end plate 522 of the perforating gun assembly 600 of FIG. 6. The top end plate 522 includes an inner bore 525.

Figure 10A:
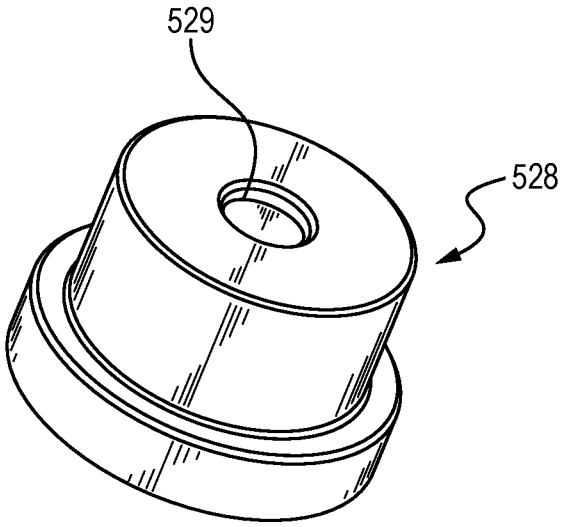
FIG. 10A is a perspective view of an optional insert. The insert fits into the top end plate of FIG. 10.

FIG. 10A is a perspective view of an insert 528. The insert 528 fits into the top end plate 522 of FIG. 10. The insert 528 includes a central opening 529 that is dimensioned to receive the insulator 530 of FIG. 7A. In this way, communication wires are passed from the end plate 522, through the carrier tube 500 and down to a next tandem sub 400.

Figure 11:
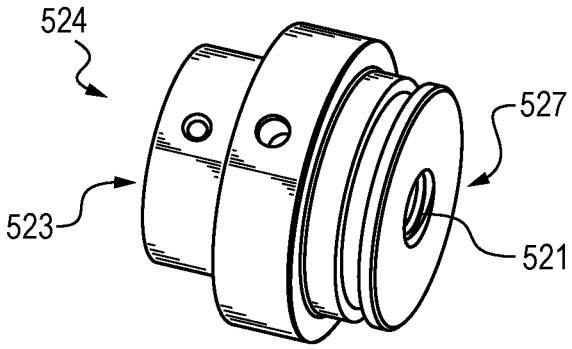
FIG. 11 is a perspective view of the bottom end plate of the perforating gun assembly of FIG. 6.

FIG. 11 is a perspective view of the bottom end plate 524 of the perforating gun assembly 600 of FIG. 6. The bottom end plate 524 includes an inner conduit 521 that is dimensioned to receive the insulator 535 of FIG. 8A. Communication wires are passed through the insulator 535 and to the addressable switch 552 in the tandem sub 400.

Figure 12A:
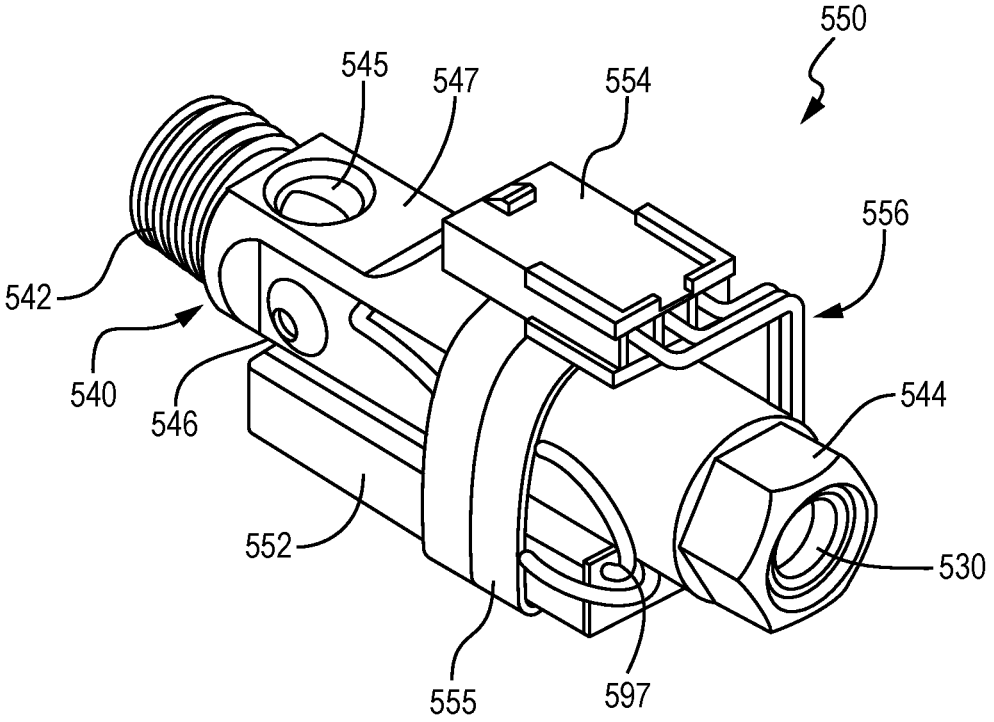
FIG. 12A is a perspective view of a switch assembly of the present invention, in one embodiment. The stem of FIG. 8 is shown as part of the switch assembly.
Figure 12B:
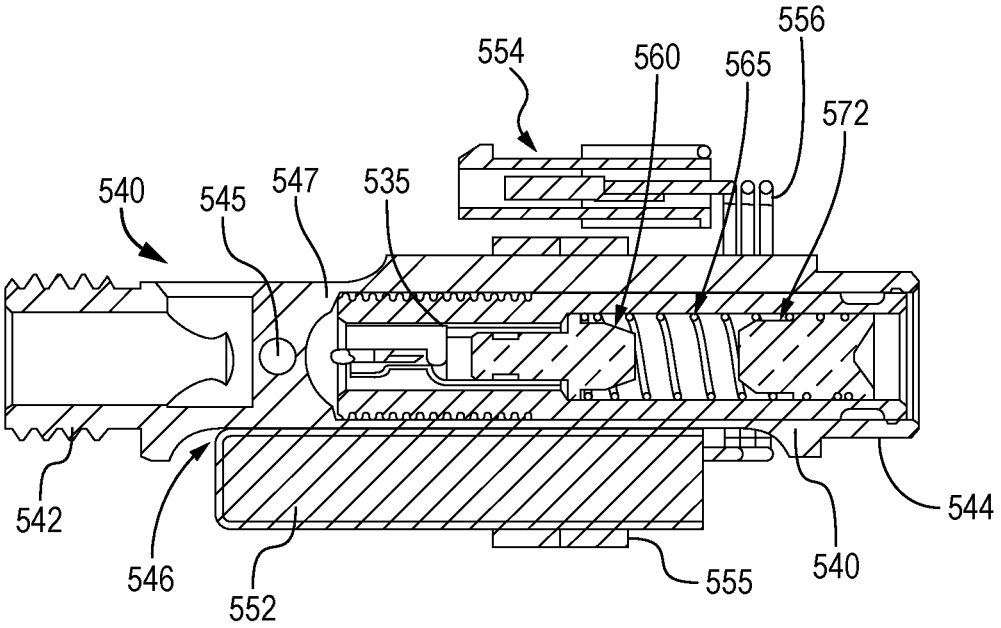
FIG. 12B is a cross-sectional view of the switch assembly of FIG. 12A. The stem of FIG. 8 is again shown.

FIG. 12A is a perspective view of a switch assembly 550 of the present invention, in one embodiment. The switch assembly 550 is attached to the stem 540 of FIG. 8. The switch assembly 550 includes the addressable switch 552 from FIG. 6. The addressable switch 552 may be secured to the stem 540 along a flat 546 by means of a simple rubber band 555, or other connector.

A wiring board 554 is provided along the stem 540 opposite the addressable switch 552. The wiring board 554 may be a circuit board, or more preferably is a simple 3-pin push connector. Communication wires 556 extend from the circuit board 554 to the addressable switch 552. These wires 556 are received from an upstream detonator 594 as shown more fully in FIG. 15C, discussed below.

A separate communications wire 597 extends from the addressable switch 552. The communications wire 597 provides signals for the "next" selection gun as a signal line.

FIG. 12B is a cross-sectional view of the switch assembly 550 of FIG. 12A. The stem 540 is again shown. Male threaded end 542 is seen at one end, while female end 544 is shown at an opposing end. Intermediate the opposing ends 542, 544 is a platform 547. The platform 547 includes an opening 545. The opening 545 provides access to wiring.

A separate communications wire 597 extends from the addressable switch 552. The communications wire 597 provides signals for the "next" selection gun.

Also visible in FIG. 12B are a proximal contact 560 and a spring 565. In addition, a contact head 572 is seen. The contact head 572 is connected to an electric contact pin, shown at 570 in FIGS. 18 and 19. The spring 565 maintains spacing between the proximal contact 560 and the contact head 572.

The switch assembly 550 of FIGS. 12A and 12B is part of the detonation system. The detonation system is intended to be used in a perforating gun assembly, and operated within a wellbore. Additional components of the detonation system (or explosive initiation assembly) include the tandem sub 400 of FIG. 4, the contact pin 570 of FIGS. 18 and 19, the end plate 524 of FIG. 13, and a dart (shown at 700 in FIG. 17A).

Figure 13:
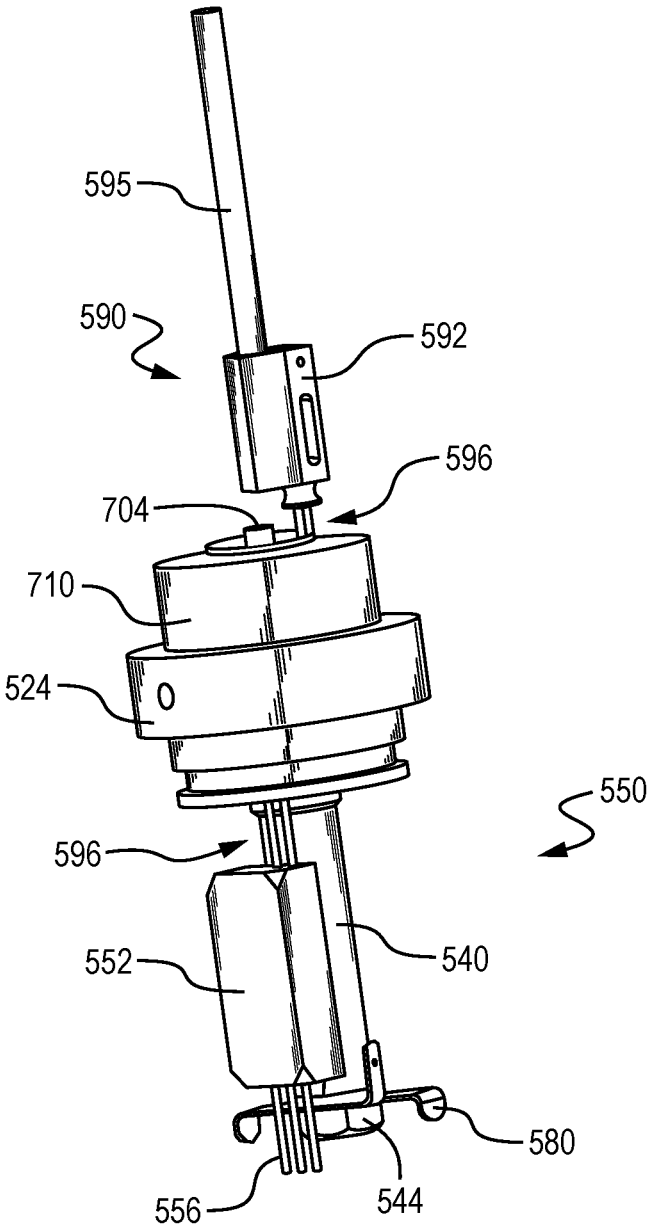
FIG. 13 is a perspective view of electronics associated with a detonation system of the present invention, in one embodiment. Visible is a bottom end plate and a connected dart retainer. Extending away from the dart retainer opposite the electronics is a detonator block and detonating cord.

FIG. 13 is a perspective view of a portion of the detonation system associated with the perforating gun assembly 600. Visible in this view is the bottom end plate 524 and a connected dart retainer 710. The dart retainer 710 is dimensioned to slide into the bottom end 502' of the carrier tube 500 (shown in FIG. 5) as the bottom end plate 524 is screwed into the carrier tube 500. The dart retainer 710 keeps a base portion 702 of the dart 700 centered relative to the inner conduit 521 (seen in FIG. 11) of the end plate 524.

Of interest, a base 704 is seen extending out of the dart retainer 710. The base 704 is actually a lower end of a dart sleeve. The dart sleeve is shown at 706 in FIG. 17B along with the base 704. The dart sleeve 706 is fabricated from silicone and houses the dart 700.

FIG. 13 also shows a grounding bracket 580. The grounding bracket 580 is connected to wires 556. The grounding bracket 580 may optionally be used to support wires 596 as they extend up into the next perforating gun 210.

A detonator block 592 is shown above the dart retainer 710. The detonator block 592 holds a detonator (shown at 594 in FIGS. 15B and 15C) on one side, and the end of a detonating cord 595 on the other side. The detonator block 592, the detonating cord 595 and the detonator 596 reside together in the carrier tube 500. Of interest, the detonating cord 595 is sheathed in a flexible outer case, typically plastic, and contains a high-explosive material. An example of an explosive material is the RDX compound. The detonating cord 595 is connected to charges 520 along the carrier tube 500 and delivers the ignition for detonation.

FIG. 13 also shows a detonation assembly 590. The detonation assembly 590 includes a detonator block 592. The detonator block 592 is preferably fabricated from plastic, and holds a detonator 594 and a detonating cord 595. More specifically, the detonator block 592 mechanically connects the detonator 594 to an end of the detonating cord 595.

Figure 15A:
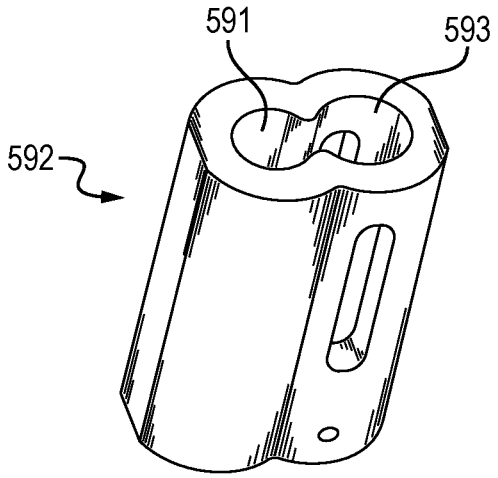
FIG. 15A is a perspective view of a detonator block as may be used in a gun barrel of a perforating gun assembly.

FIG. 15A is a perspective view of the detonator block 592 from FIG. 13. Here, the detonator 594 and the detonating cord 595 have been removed. Cavities 591 and 593 are visible. Cavity 591 receives the detonating cord 595 while cavity 593 receives the detonator 594 itself.

Figure 15C:
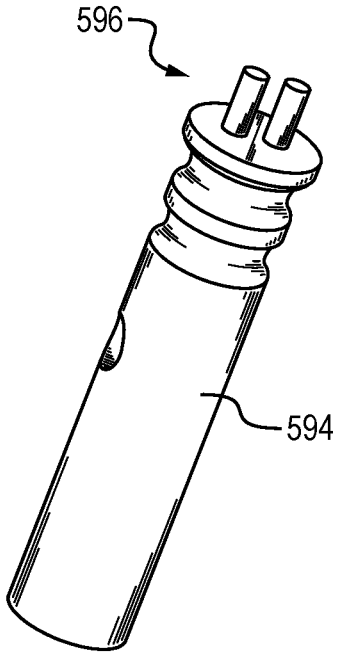
FIG. 15C is a perspective view of an illustrative detonator for the detonation assembly of FIG. 15A.
Figure 15B:
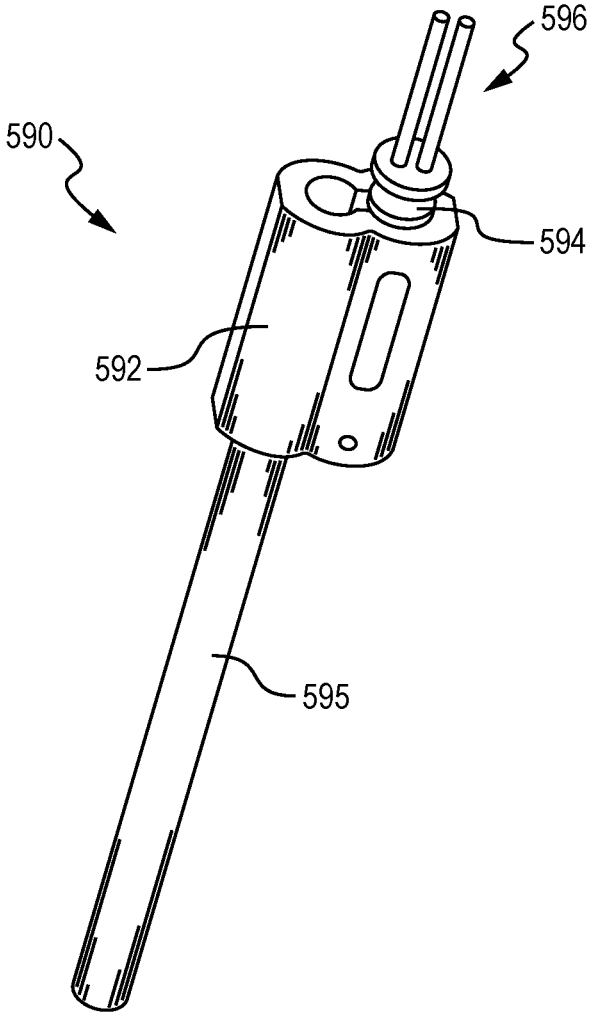
FIG. 15B is a perspective view of a detonation assembly. The detonation assembly includes the detonator block of FIG. 15A. The detonator block has received a detonator and a detonating cord. The detonator block places the detonator in proximity to an end of the detonating cord with its explosive material.

FIG. 15B is a perspective view of a detonator assembly 590. Cavities 591 and 593 of the detonator block 592 have received the detonator 594 and the detonating cord 595, respectively. The detonator block 592 places the detonator 594 in proximity to the detonating cord 595 for ignition.

FIG. 15C is a perspective view of an illustrative detonator 594 for the detonator block 592 of FIG. 15B. Wires 596 are seen extending from the detonator 594. Two wires are shown, which may represent a power wire and a ground wire. However, it is understood that additional wires for power or for signaling may be provided.

Figure 14:
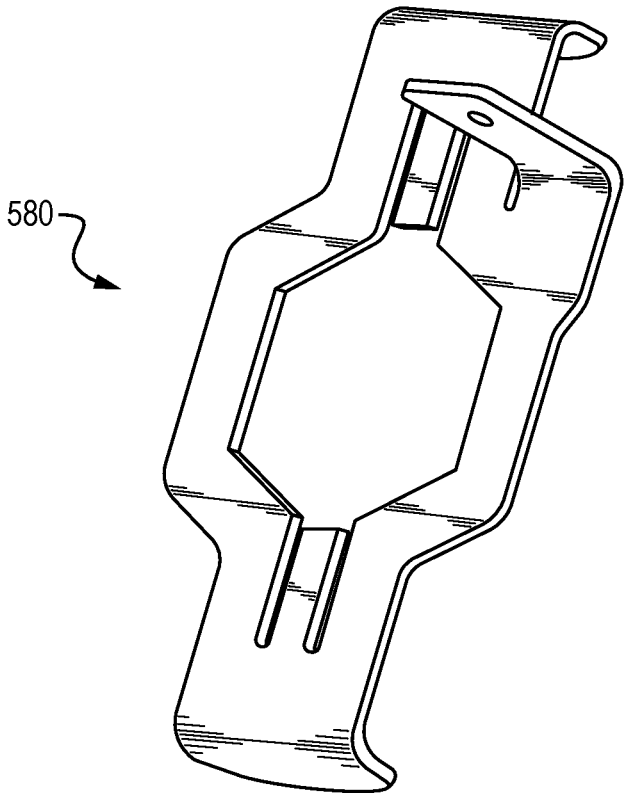
FIG. 14 is a perspective view of a grounding bracket. The grounding bracket may optionally be used to support wires extending up from a tandem sub and to the addressable switch. The grounding bracket is also partially visible in FIG. 13.

Returning to FIG. 13, below the bottom end plate 524 is the stem 540 and the addressable switch 552. Wires 596 are seen entering the addressable switch 552. Below the stem 540 and the addressable switch 552 is a grounding bracket 580. FIG. 14 is a perspective view of the grounding bracket 580.

As shown in FIG. 13, the detonator block 592 resides above the dart retainer 710. The dart retainer 710 is used to secure the dart 700 as it approaches the bottom end plate 524. However, it is understood that the view of FIG. 13 may be flipped so that the detonator block 592 resides below dart retainer 710.

Figure 16A:
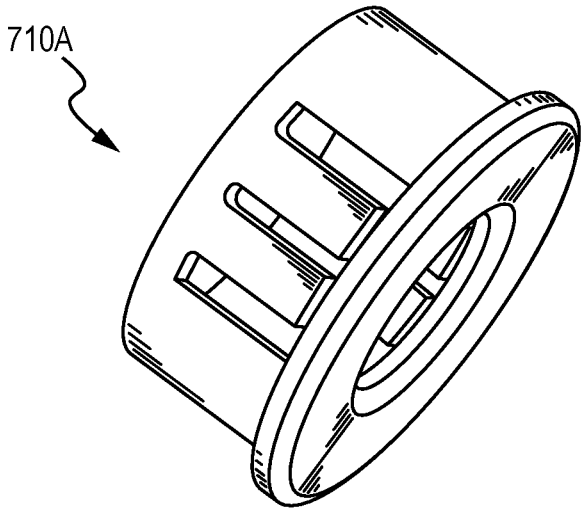
FIG. 16A is a dart retainer as may be used in the detonation system of the present invention, in one embodiment.
Figure 16B:
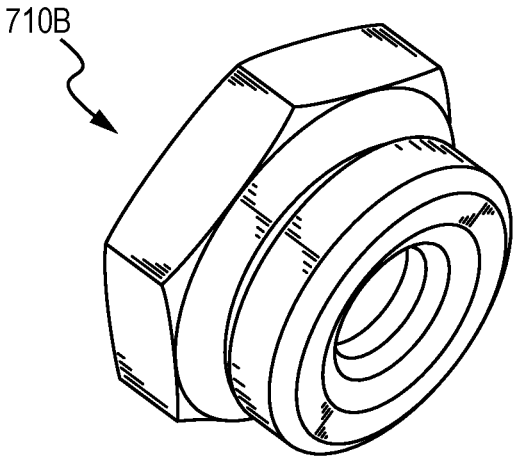
FIG. 16B is a dart retainer as may be used in the detonation system of the present invention, in an alternate embodiment.

FIG. 16A is a perspective view of a dart retainer 710A as may be used in connection with a detonation system of the present invention, in one embodiment. FIG. 16B is an alternate arrangement for a dart retainer 710B. In either arrangement, the dart retainer 710 resides partially along the bottom end plate 524.

Figure 17A:
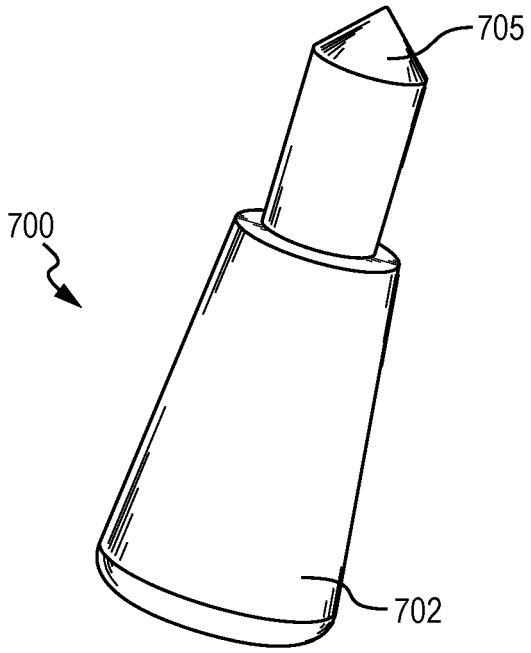
FIG. 17A is a perspective view of a dart as may be used as part of the detonation system of the present invention, in one embodiment.

FIG. 17A is a perspective view of dart 700 as may be used as part of the detonation system of the present invention, in one embodiment. As noted, the dart 700 comprises a base portion 702. Opposite the base portion 702 is a tip 705. The dart 700 is fabricated from a malleable yet durable material, such as a soft metal. A suitable example is aluminum or an alloy comprised substantially of aluminum. As described further below, the dart 700 deforms in response to the detonation of charges 520 in a perforating gun 210, sealing off the addressable switch 552 from the pressure wave and from exposure to wellbore fluids and debris created by the detonation of charges from an adjacent perforating gun.

Figure 17B:
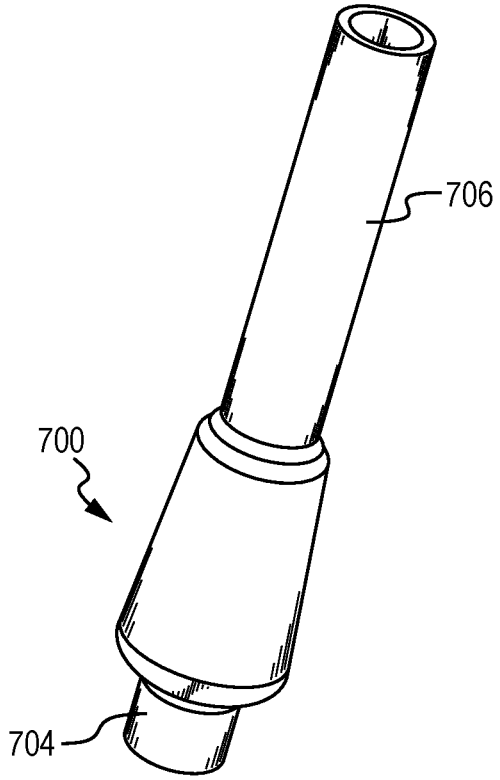
FIG. 17B is a perspective view of a sleeve having been placed over the dart of FIG. 17A.

FIG. 17B is a perspective view of a sleeve 706 having been placed over the tip 705 of the dart 700. A base 704 of the sleeve 706 is visible. The sleeve 706 is fabricated from silicone. The sleeve 706 resides within the dart retainer 710 and the bottom end plate 524 and helps hold the dart 700 in place.

As observed in connection with FIG. 11, the bottom end plate 524 includes an inner conduit 521. At opposing ends of the conduit 521 is a first internal chamber 523 and a second internal chamber 527. The base portion 702 of the dart 700 resides within the first internal chamber 523 while the tip 705 extends at least partially into the conduit 521 between the first 523 and second 527 internal chambers.

In operation, the dart 700 is loosely placed in the first internal chamber 523 so that the tip 705 is located partially inside the conduit 521, i.e., between the first 523 and second 527 chambers. The one or more wires 556 extend from the addressable switch 552, through the conduit 521, out of the first internal chamber 523, into the carrier tube 500, and to the detonator 594. The one or more wires 556 pass along an exterior of the dart 700, held closely to the dart 700 by the dart retainer 710. Note that when charges 520 are detonated and the dart 700 seals against the conduit 521, the wires 556 will be pinched and severed.

Figure 18:
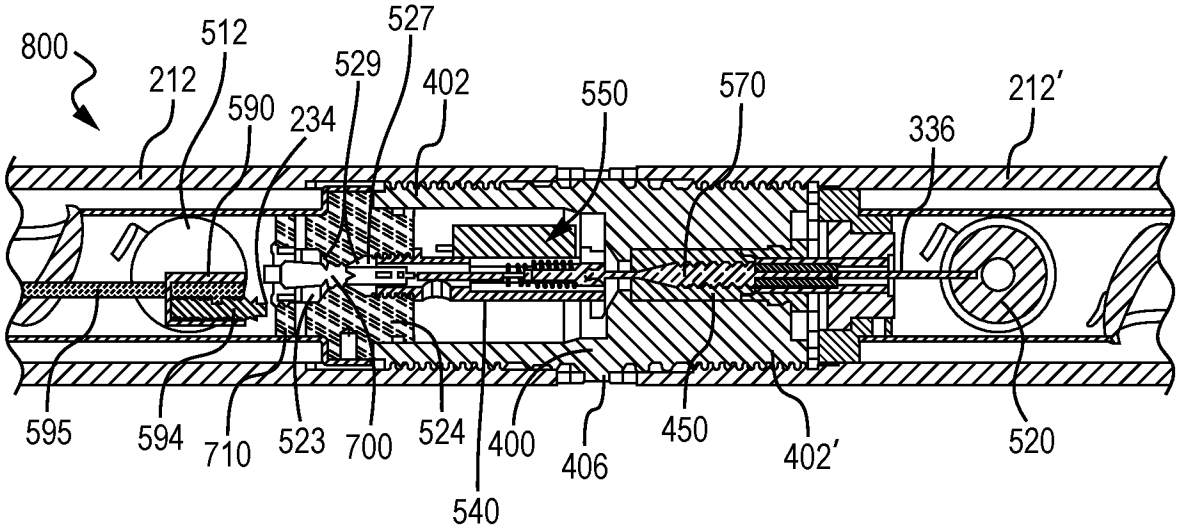
FIG. 18 is a side, cross-sectional view of a detonation system for the perforating gun assembly of FIG. 6, in one embodiment.

FIG. 18 is a side, cross-sectional view of a detonation system 800, in one embodiment. The system 800 includes the tandem sub 400 of FIG. 4 with its opposing male threaded sides 402, 402'. Opposing gun barrels 212, 212' are each threadedly connected to the tandem sub 400 on a respective side 402, 402'. Gun barrel 212 is considered upstream of the sub 400 while gun barrel 212' is downstream of the sub 400.

A detonator assembly 590 is seen in the upstream gun barrel 212. The detonator assembly 590 includes the detonator block 592, the detonating cord 595 and the detonator 594 itself. At the same time, the electronic switch assembly 550 resides within the tandem sub 400, and more particularly within a bore of the tandem sub 400.

The bottom end plate 524 is shown between the upstream gun barrel 212 and the tandem sub 400. The dart retainer 710 is also visible along with the dart 700. It can be seen that the base portion 702 of the dart 700 resides along the dart retainer 710 but the tip 705 extends into the bottom end plate 524. An inner diameter (or conduit 521) of the bottom end plate 524 is dimensioned to prevent the base portion 702 of the dart 700 from passing through to the tandem sub 400. This protects the switch assembly 550 upon detonation of the charges 520 in the upstream gun barrel 212. Note that in this view the dart 570 is shown in a somewhat deformed state for illustrative purposes.

It is understood that the relative arrangement of the gun barrel 212, the bottom end plate 524, the dart 700, the electronic switch assembly 550 and all other components of the perforating gun assembly 600 may be "flipped." In this way, the switch assembly 550 is protected from a pressure wave upon detonation of charges in a downstream gun barrel 212' by use of the dart 700.

Figure 19:
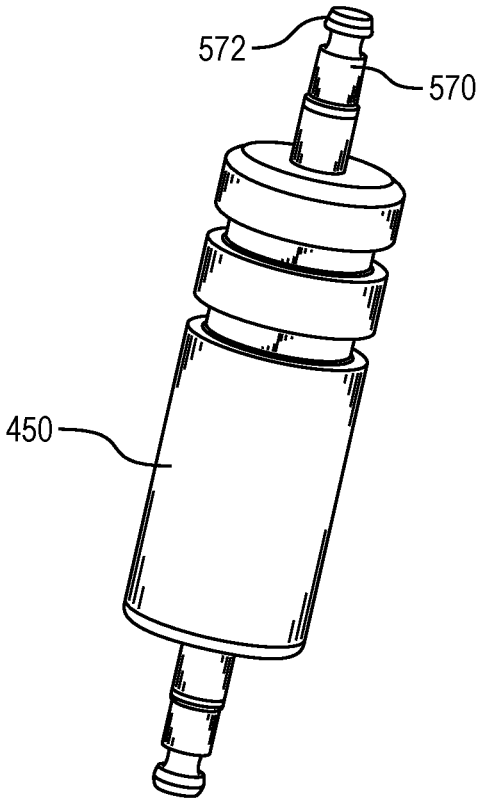
FIG. 19 is a perspective view of a bulkhead assembly. An electrical contact pin resides inside of a bulkhead, with a contact head seen extending out from the bulkhead.

FIG. 19 is a perspective view of a bulkhead 450. The bulkhead 450 is fabricated from a non-conductive material such as plastic (poly-carbonate) or nylon. An electrical contact pin 570 resides inside of the bulkhead 450. The contact pin 570 defines an elongated shaft that is fabricated from an electrically conductive material, such as brass. The shaft extends through a bore (not visible) of the bulkhead 450.

In FIG. 19, the contact head 572 at the end of the contact pin 570 is visible. The contact head 572 is configured to transmit electrical current to a spring-loaded electrical terminal, or contact pin 560. From there, electrical energy is passed along to the electronic switch 552. Depending on the instructions from the surface, the electronic switch 552 may be activated to send a detonation signal to the detonator 594 within the adjacent perforating gun 212, or to a next perforating gun as an electrical detonation signal.

Figure 20:
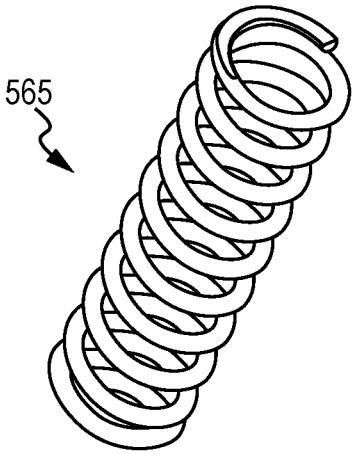
FIG. 20 is a perspective view of a spring. The spring resides inside the insulator of FIG. 8A.

FIG. 20 is a perspective view of the spring 565. The spring 565 resides inside the insulator 535 of FIG. 8A. The spring 565 biases the contact head 572 away from the proximal contact pin 560 within the stem 540.

In operation, a detonation signal is sent from the surface 105 through the electric line 240. The signal reaches the electrical contact pin 570 by means of a signal wire. The contact pin 570 is fabricated from an electrically conductive material and transmits the detonation signal to an addressable switch 552. The electrical contact pin 570 resides within the tandem sub 400, with the contact head 572 extending into the stem 540. The contact head 572 is caused to contact the proximal contact pin 560 (shown in FIG. 12A), completing the circuit. A detonation charge is then sent to the detonator 594, which ignites the charges 520 of the upstream gun barrel 212.

The pressure wave from the charges acts against the dart 700, causing it to deform against an angled inner surface (shown at 529 in FIG. 18 along inner chamber 523) within the conduit 521 of the bottom end plate 524. To this end, an external diameter of the base portion 702 is larger than a diameter of the conduit 521, while an external diameter of the tip portion 705 is smaller than the diameter of the conduit 521. Thus, the conduit 521 is sealed so that no debris or wellbore fluid enters the second chamber 527. In this way, the tandem sub 400 itself is sealed and the electronics 550 inside the sub 400 are protected from damage from the upstream perforating gun assembly 210. Detonation severs the wires 596 at the angled inner surface 527.

As can be seen, a novel detonation system is provided. The detonation system provides protection for the electronics within the tandem sub during detonation of an upstream (or adjacent) perforating gun. In one embodiment, the detonation system first includes the novel tandem sub. The tandem sub defines a generally tubular body having a first end and a second end. The first end and the second end each comprise male connectors. This allows the tandem sub to be threadedly connected, in series, to respective perforating guns. Thus, the first end is threadedly connected to a first perforating gun (or, more precisely, a female threaded end of a gun barrel), while the second end is threadedly connected to a second perforating gun (or, again, a female threaded end of a gun barrel).

Beneficially, the tandem sub 400 need not have a wiring port. Removing the port from the sub eliminates problems associated with known ports such as gun-flooding due to a missing o-ring and pinched wires under the plug port. The detonator is installed later in the field to comply with DOT and ATF regulations and API-RP67 recommendations.

The first end of the tandem sub abuts a first (or bottom) end plate. Similarly, the second opposing end of the tandem sub abuts a second (or top) end plate. These may be in accordance with the bottom 524 and top 522 end plates described above. An inner bore is formed between the first end and the second end of the tandem sub. Detonation and signal wires from the tandem sub extend up through the bottom end plate.

An electronic switch assembly resides within the inner bore at the first end of the tandem sub. The switch assembly comprises an addressable switch configured to receive instruction signals from an operator at the surface.

In addition, a receptacle is formed within the inner bore of the tandem sub. The receptacle is dimensioned to closely receive a bulkhead. The bulkhead comprises:

- a tubular body having a first end, a second end and a bore extending there between;
- an electrical contact pin having a shaft extending through the bore of the bulkhead body and having a first end and a second end, wherein the shaft frictionally resides within the bore, and wherein the electrical contact pin transmits current from the first end to the second end; and a contact head located at the second end of the electrical contact pin outside of the bulkhead body and extending into the electronic switch assembly.

The electrical contact pin and its contact head are fabricated substantially from a conductive material such as brass. The contact pin permits instruction signals to be transmitted from the tandem sub down to a next (downstream) perforating gun.

The first end plate comprises a bore that defines a first internal chamber formed at a first end of the end plate, a second internal chamber formed at a second end of the end plate, and a conduit connecting the first internal chamber to the second internal chamber.

One or more wires pass from the addressable switch, through the conduit of the first end plate, and to a detonator residing within the first perforating gun. The detonator is configured to receive detonation signals from the addressable switch, and ignite an explosive material within a detonating cord. The explosive material travels to shaped charges associated with the first perforating gun to ignite the charges. Thus, the tandem sub is an electrical feed-thru, pressure barrier that has been configured to allow room for a switch assembly.

All electrical connections for the detonation system may be made at the gun building facility, that is, except for the wires being connected to the detonator. The end plate on the gun barrel (or gun carrier) is removed, and the pre-wired electronic switch assembly is installed. Beneficially, the pre-wired switch assembly can be tested at the gun building facility to reduce the chance of a mis-wired connection.

A dart resides in the first internal chamber of the first end plate, opposite the switch assembly. The dart has a tip that extends at least partially into the conduit between the first and second internal chambers. The dart further comprises a base located in the first internal chamber. The base has a diameter that is larger than the conduit. The dimension of the base prevents the dart from traversing through the conduit following detonation of the shaped charges.

Figure 21:
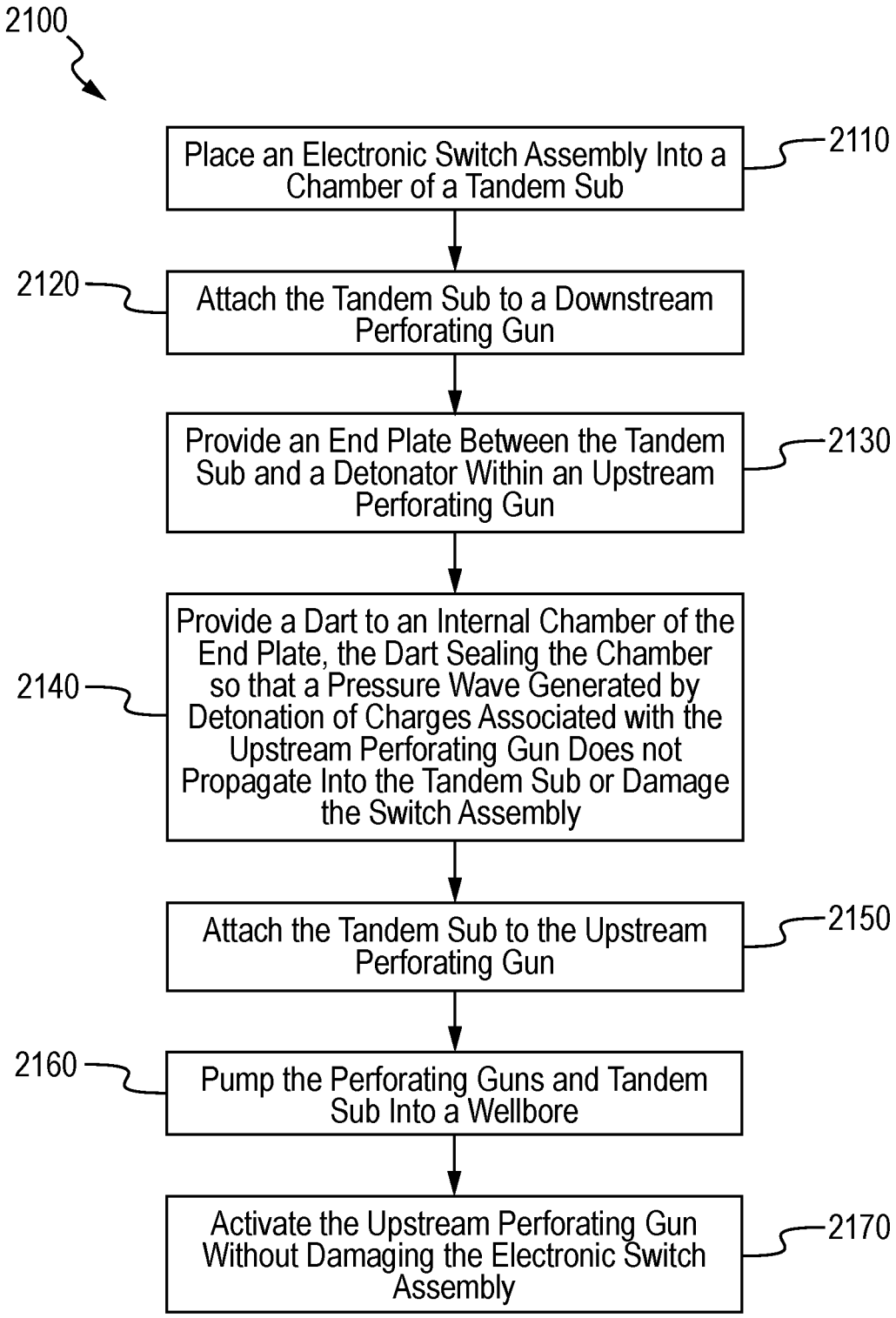
FIG. 21 presents a flow chart showing steps for a method of detonating explosive charges associated with a perforating gun.

In addition to the detonation system discussed above, a method of detonating explosive charges associated with a perforating gun is presented herein. FIG. 21 is a flow chart showing steps for a method 2100 of detonating explosive charges associated with a perforating gun.

The method 2100 first comprises placing an electronic switch assembly into a chamber of a tandem sub. This is provided in Box 2110.

The method 2100 next includes attaching the tandem sub to a downstream perforating gun. This is indicated at Box 2120.

The method 2100 also includes providing an end plate at a top end of the tandem sub. The end plate will reside between the tandem sub and an upstream perforating gun. This is shown at Box 2130. The end plate is preferably a bottom end plate as it resides at the bottom of the upstream perforating gun.

The method 2100 further comprises providing a dart to an internal chamber of the end plate. This is shown at Box 2140. In the step of Box 2140, the dart is configured to seal an inner conduit that would otherwise be in fluid communication with the chamber of the tandem sub. In this way, a pressure wave generated by detonation of charges associated with the upstream perforating gun does not propagate into the tandem sub or damage the switch assembly. Note that the step of Box 2140 is broad enough to include using a dart retainer adjacent the end plate, with the dart sealing a conduit through the dart retainer.

The method 2100 also includes attaching the tandem sub to the upstream perforating gun. This is indicated at Box 2150. Stated another way, the upstream perforating gun is attached to the tandem sub at an end opposite the downstream perforating gun. A perforating gun assembly is thus formed.

In practice, the electronic switch assembly may be installed onto a bottom end plate, which is connected to a charge carrier tube, which in turn is housed in a gun barrel with the dart. The tandem sub is then installed onto the gun barrel with the internal bore of the tandem sub enclosing over the electronic switch assembly.

The method 2100 further comprises pumping the perforating guns and tandem sub into a wellbore. This is seen at Box 2160. Preferably, the perforating gun assembly is pumped into the horizontal portion of the wellbore for perforating casing.

The method 2100 then includes activating the upstream perforating gun without damaging the electronic switch assembly in the tandem sub. This is provided in Box 2170. Activating the upstream perforating gun means that charges associated with the upstream perforating gun are detonated in response to a charge signal sent to a detonator within the perforating gun.

In operation, the operator will send a control signal from the surface, down the e-line (such as e-line 240 of FIG. 2), and to the bulkhead. The electrical signal is specifically sent through the contact pin and to the contact head. From there, the signal is sent to the electronic switch. The switch is armed and a window of time is opened (typically about 30 seconds) in which to send a detonation signal from the surface. As part of the detonation signal, an instruction is sent telling the upstream perforating gun (or the detonator within the upstream perforating gun) to be activated.

The charges in the upstream perforating gun are detonated. Due to the soft characteristic of the material from which the dart is made, the dart will deform to fully occupy a portion of the inner conduit. Although the power and control wires passing through the conduit are severed during this process, the integrity of the switch assembly in the tandem sub is preserved and, thus, the switch assembly may be reused for another perforation operation. Similarly, the contact pin, the bulkhead, and the tandem sub itself are protected for later re-use.

Before the detonation of the upstream perforating gun, the electronic switch can feed current down to a next perforating gun (or to a bulkhead associated with a next perforating gun), depending on the instruction.

The disclosed embodiments provide methods and systems for preventing electronics located inside a switch sub from being damaged by detonation of an adjacent perforating gun. It should be understood that this description is not intended to limit the invention; on the contrary, the exemplary embodiments are intended to cover alternatives, modifications, and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

Further, variations of the detonation system and of methods for using the detonation system within a wellbore may fall within the spirit of the claims, below. It will be appreciated that the inventions are susceptible to other modifications, variations, and changes without departing from the spirit thereof.

We claim:

1. A detonation system for a perforating gun assembly, comprising:

a tandem sub defining a tubular body having a first end and a second opposing end, with no intermediate port;

a perforating gun comprising a carrier tube, a plurality of charges residing within the carrier tube, and a gun barrel;

an electronic switch assembly residing within an inner bore of the tandem sub, wherein the electronic switch assembly comprises an addressable switch configured to receive a detonation signal from the surface;

an end plate residing between the carrier tube and the tandem sub, the end plate having an inner conduit, and wherein the inner conduit receives one or more wires from the electronic switch assembly en route to the perforating gun;

a dart having a base portion and a tip, wherein the base portion has an outer diameter that is greater than the inner conduit of the end plate, and a tip that extends at least partially into the inner conduit; and a detonator residing within the carrier tube, the detonator being in electrical communication with the electronic switch assembly by means of the one or more wires;

and wherein:

the first end of the tandem sub is threadedly connected to the gun barrel; and the dart is configured to seal against the inner conduit of the end plate in response to a pressure wave generated by detonation of the plurality of charges in the carrier tube, severing the one or more wires.

2. The detonation system of claim 1, wherein:

the bottom end plate comprises a first internal chamber and a second internal chamber;

the base portion of the dart resides within the first internal chamber while the tip extends at least partially into the inner conduit between the first and second internal chambers;

and the detonation system further comprises a contact pin also residing within the inner bore of the tandem sub and having a head that extends into the electronic switch assembly, the contact pin configured to transmit instruction signals from the surface to a downstream perforating gun.

3. A detonation system for a perforating gun assembly, the perforating gun assembly having a carrier tube, a plurality of charges residing within the carrier tube, and a gun barrel holding the carrier tube, and the detonation system comprising:

a tandem sub defining a tubular body having a first end and a second opposing end, with no intermediate port;

an inner bore within the tandem sub extending from the first end to the second opposing end;

an electronic switch assembly residing within the inner bore of the tandem sub proximate the first end;

a contact pin also residing within the inner bore of the tandem sub and having a head that extends into the electronic switch assembly, the contact pin configured to transmit instruction signals from the surface to a downstream perforating gun;

an end plate residing between the carrier tube and the tandem sub, the end plate having an inner conduit, and wherein the inner conduit receives one or more wires from the electronic switch assembly;

a dart having a base portion and a tip, wherein the base portion has an outer diameter that is greater than the inner conduit of the end plate, and a tip that extends at least partially into the inner conduit; and a detonator residing within the carrier tube, the detonator being in electrical communication with the electronic switch assembly by means of the one or more wires;

and wherein:

the first end of the tandem sub is threadedly connected to the gun barrel; and the dart is configured to seal against the inner conduit of the end plate in response to a pressure wave generated by detonation of the plurality of charges in the carrier tube.

4. The detonation system of claim 3, wherein:

the perforating gun assembly resides within a wellbore;

the electronic switch assembly comprises an addressable switch;

the contact pin is in electrical communication with an e-line that extends from the perforating gun assembly up to the surface; and the detonator is configured to ignite an explosive material that travels through a detonating cord and to the plurality of charges residing within the carrier tube in response to detonation signal sent to the addressable switch.

5. The detonation system of claim 4, further comprising:

a dart retainer residing within the carrier tube adjacent the end plate, the dart retainer having an inner diameter dimensioned to slideably hold the dart;

a tubular stem having a first end threadedly connected to the end plate, the tubular stem having an inner diameter and an outer diameter and residing within the tandem sub;

and wherein the head of the contact pin extends into the inner diameter of the stem, and the addressable switch resides along the outer diameter of the stem.

6. The detonation system of claim 4, wherein the gun barrel is upstream of the tandem sub.

7. The detonation system of claim 4, wherein the gun barrel is downstream of the tandem sub.

8. The detonation system of claim 4, wherein:

the contact pin is fabricated substantially from a conductive material;

the contact pin comprises a body and the head; and the body of the contact pin resides within a bulkhead within the tandem sub.

9. The detonation system of claim 8, wherein:

the inner conduit of the end plate comprises an angled inner surface;

detonation of the charges along the carrier tube causes the dart to sever the one or more wires against the angled inner surface; and each of the first and second ends of the tandem sub comprises male threads.

10. A tandem sub for a perforating gun assembly, comprising:

a tubular body comprising a first end, an opposing second end, and an inner bore extending from the first end to the second end with no intermediate through-port; and an external shoulder along an outer diameter of the tubular body;

an electronic switch assembly residing within the inner bore proximate the first end of the tandem sub, the switch assembly comprising an addressable switch configured to receive instruction signals from an operator at the surface, and wherein:

the first end of the tubular body is threadedly connected to a gun barrel housing for a first perforating gun, and abuts a first end plate;

the second opposing end of the tubular body is threadedly connected to a gun barrel housing for a second performing gun, and abuts a second end plate, a receptacle is formed within the inner bore of the tandem sub, the receptacle being dimensioned to closely receive a bulkhead, wherein the bulkhead comprises, a tubular body having a first end, a second end and a bore extending there between;

an electrical contact pin having a shaft extending through the bore of the tubular body of the bulkhead, wherein the shaft resides closely within the bore; and a contact head located at an end of the electrical contact pin outside of the tubular body of the bulkhead and extending into the electronic switch assembly, and wherein:

the first end plate comprises a bore that represents a first internal chamber formed at a first end of the first end plate, a second internal chamber formed at a second end of the first end plate, and an inner conduit connecting the first internal chamber to the second internal chamber.

11. The tandem sub of claim 10, wherein:

one or more wires pass from the addressable switch, through the inner conduit, and to a detonator residing within the first perforating gun, the detonator being configured to receive detonation signals from the addressable switch, and ignite an explosive material in a detonating cord connected to shaped charges associated with the first perforating gun.

12. The tandem sub of claim 11, wherein:

a dart resides in the first internal chamber of the first end plate and opposite the switch assembly, the dart having a tip that extends at least partially into the inner conduit between the first and second internal chambers;

the dart further comprises a base located in the first internal chamber, with the base having a diameter that is larger than the inner conduit, thereby preventing the dart from traversing through the conduit following detonation of the shaped charges;

the dart is configured to seal against the inner conduit of the end plate in response to a pressure wave generated by detonation of the charges in the carrier tube; and the contact pin is fabricated substantially from an electrically conductive material for transmitting current.

13. The tandem sub of claim 12, wherein:

the first perforating gun is upstream of the tandem sub.

14. The tandem sub of claim 13, wherein:

the inner conduit of the end plate comprises an angled inner surface; and detonation of the charges in the perforating gun causes the dart to sever the one or more wires against the angled inner surface.

15. A method of detonating explosive charges associated with a perforating gun, comprising:

providing a tandem sub having an upstream end, a downstream end, and an inner chamber between the upstream and downstream ends with no intermediate port;

placing an electronic switch assembly into the chamber of the tandem sub;

attaching a downstream perforating gun to the downstream end of the tandem sub;

providing a bottom end plate at the upstream end of the tandem sub, the bottom end plate comprising an inner conduit;

providing a dart at least partially within the inner conduit of the bottom end plate;

attaching the tandem sub to an upstream perforating gun, wherein the bottom end plate resides between the upstream perforating gun and the tandem sub, and thereby forming a perforating gun assembly;

pumping the perforating gun assembly into a wellbore; and activating the upstream perforating gun without damaging the electronic switch assembly in the tandem sub;

wherein the dart is configured to seal the chamber of the tandem sub so that a pressure wave generated by detonation of charges associated with the upstream perforating gun does not propagate into the tandem sub or damage the switch assembly.

16. The method of claim 15, wherein:

the wellbore comprises a horizontal leg;

the perforating gun assembly is pumped into the horizontal leg; and the upstream perforating gun is activated within the horizontal leg to perforate casing at a desired depth.

17. The method of claim 16, wherein:

each of the upstream and downstream ends of the tandem sub comprises a male connector, with the upstream end being threadedly connected to the upstream perforating gun and abuts the bottom end plate, and the downstream end being threadedly connected to the downstream perforating gun;

the switch assembly comprises an addressable switch configured to receive instruction signals from an operator at the surface; and activating the upstream perforating gun comprises sending a signal from the surface, down an electric line and to the electronic switch assembly.

18. The method of claim 17, wherein the tandem sub further comprises:

a receptacle within the inner bore of the tandem sub, the receptacle being dimensioned to closely receive a bulkhead, wherein the bulkhead comprises:

a tubular body having a first end, a second end and a bore extending there between;

an electrical contact pin having a shaft extending through the bore of the bulkhead body, wherein the shaft closely resides within the bore; and a contact head located at an end of the electrical contact pin outside of the tubular body of the bulkhead and extending into the electronic switch assembly.

19. The method of claim 17, wherein:

the bottom end plate comprises a bore that represents a first internal chamber formed at a first end of the end plate, a second internal chamber formed at a second end of the end plate, and wherein the inner conduit connects the first internal chamber to the second internal chamber;

one or more wires pass from the addressable switch, through the inner conduit, and to a detonator residing within the upstream perforating gun;

the dart resides in the first internal chamber of the end plate and opposite the switch assembly, with the dart having a tip that extends at least partially into the inner conduit between the first and second internal chambers;

the dart further comprises a base located in the first internal chamber, with the base having a diameter that is larger than the inner conduit, thereby preventing the dart from traversing through the conduit following detonation of the shaped charges; and the dart seals against the inner conduit of the end plate in response to a pressure wave generated by detonation of the charges in the upstream perforating gun;

and wherein sending a signal down the electric line and to the electronic switch assembly to activate the upstream perforating gun further comprises sending the signal through the one or more wires and to the detonator.

* * * * *